US011456532B2

(12) United States Patent
Khachaturian et al.

(10) Patent No.: US 11,456,532 B2
(45) Date of Patent: Sep. 27, 2022

(54) MODULAR OPTICAL PHASED ARRAY

(71) Applicant: California Institute of Technology, Pasadena, CA (US)

(72) Inventors: Aroutin Khachaturian, Pasadena, CA (US); Seyed Ali Hajimiri, La Canada, CA (US); Behrooz Abiri, Pasadena, CA (US); Seyed Mohammadreza Fatemi, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 15/587,391

(22) Filed: May 4, 2017

(65) Prior Publication Data

US 2017/0324162 A1 Nov. 9, 2017

Related U.S. Application Data

(60) Provisional application No. 62/331,586, filed on May 4, 2016.

(51) Int. Cl.
*H01Q 3/26* (2006.01)
*H01Q 21/22* (2006.01)
(Continued)

(52) U.S. Cl.
CPC ..... *H01Q 3/2676* (2013.01); *H01Q 21/0087* (2013.01); *H01Q 21/061* (2013.01); *H01Q 21/065* (2013.01); *H01Q 21/22* (2013.01)

(58) Field of Classification Search
CPC .... H01Q 3/2676; H01Q 3/26; H01Q 21/0087; H01Q 21/061; H01Q 21/065;
(Continued)

(56) References Cited

U.S. PATENT DOCUMENTS 4,686,533 A 8/1987 MacDonald et al.
4,833,336 A 5/1989 Kraske
(Continued)

FOREIGN PATENT DOCUMENTS

CN 1819485 A 8/2006
CN 1902763 A 1/2007
(Continued)

OTHER PUBLICATIONS

U.S. Appl. No. 15/728,329, Non-Final Office Action dated Jan. 19, 2018.

(Continued)

*Primary Examiner* — Collin X Beatty

(74) *Attorney, Agent, or Firm* — Weaver Austin Villeneuve & Sampson LLP; Ardeshir Tabibi

(57) ABSTRACT

A phased array includes, in part, M×N photonic chips each of which includes, in part, an array of transmitters and an array of receivers. At least one of M and/or N is an integer greater than one. The transmitter arrays in each pair of adjacent photonics chips are spaced apart by a first distance and the receiver arrays in each pair of adjacent photonics chips are spaced apart by a second distance. The first and second distances are co-prime numbers. Optionally, at least a second subset of the M×N photonic chips is formed by rotating a first subset of the M×N photonic chips.

14 Claims, 19 Drawing Sheets
(18 of 19 Drawing Sheet(s) Filed in Color)

(51) Int. Cl.
*H01Q 21/06* (2006.01)
*H01Q 21/00* (2006.01)

(58) Field of Classification Search
CPC ..... H01Q 21/22; H01Q 21/08; G01S 3/46; G02B 6/1225; H04B 10/43; H04B 10/676; H04B 2210/006
USPC ..... 359/238; 343/893; 398/115
See application file for complete search history.

(56) References Cited

U.S. PATENT DOCUMENTS

| | | | | |
|---|---|---|---|---|
| 6,424,442 | B1 | 7/2002 | Gfeller et al. | |
| 6,894,550 | B2 | 5/2005 | Trosa et al. | |
| 7,313,295 | B2 | 12/2007 | Ghandi et al. | |
| 7,539,418 | B1 | 5/2009 | Krishnamoorthy et al. | |
| 7,623,783 | B2 | 11/2009 | Morris et al. | |
| 8,244,134 | B2 | 8/2012 | Santori et al. | |
| 8,311,417 | B1 | 11/2012 | Poggiolini et al. | |
| 9,325,419 | B1 * | 4/2016 | Kato | H04B 10/40 |
| 9,557,585 | B1 | 1/2017 | Yap et al. | |
| 10,382,140 | B2 | 8/2019 | Fatemi et al. | |
| 10,795,188 | B2 | 10/2020 | Aflatouni et al. | |
| 10,942,273 | B2 | 3/2021 | Fatemi et al. | |
| 2002/0174660 | A1 | 11/2002 | Venkatasubramanian | |
| 2002/0181058 | A1 | 12/2002 | Ger et al. | |
| 2003/0090775 | A1 | 5/2003 | Webb et al. | |
| 2004/0071386 | A1 | 4/2004 | Nunen et al. | |
| 2004/0101227 | A1 | 5/2004 | Takabayashi et al. | |
| 2004/0141753 | A1 | 7/2004 | Andreu-von Euw et al. | |
| 2005/0084213 | A1 | 4/2005 | Hamann et al. | |
| 2005/0138934 | A1 | 6/2005 | Weigert et al. | |
| 2005/0205762 | A1 | 9/2005 | Feldman et al. | |
| 2006/0034609 | A1 | 2/2006 | Morris et al. | |
| 2006/0056845 | A1 | 3/2006 | Parsons et al. | |
| 2006/0188194 | A1 | 8/2006 | Ghandi et al. | |
| 2008/0111755 | A1 | 5/2008 | Haziza et al. | |
| 2008/0181550 | A1 | 7/2008 | Earnshaw | |
| 2009/0297092 | A1 | 12/2009 | Takahashi | |
| 2010/0054653 | A1 | 3/2010 | Carothers | |
| 2010/0158521 | A1 | 6/2010 | Doerr et al. | |
| 2010/0187402 | A1 | 7/2010 | Hochberg et al. | |
| 2010/0226658 | A1 | 9/2010 | Fujimoto et al. | |
| 2010/0279537 | A1 | 11/2010 | Andrade | |
| 2011/0052114 | A1 | 3/2011 | Bernasconi et al. | |
| 2011/0064415 | A1 * | 3/2011 | Williams | G01S 13/58 398/115 |
| 2012/0087613 | A1 | 4/2012 | Rasras | |
| 2012/0207428 | A1 | 8/2012 | Roelkens | |
| 2012/0213531 | A1 | 8/2012 | Nazarathy et al. | |
| 2013/0107667 | A1 | 5/2013 | Boufounos | |
| 2015/0009068 | A1 | 1/2015 | Gregoire et al. | |
| 2015/0198713 | A1 * | 7/2015 | Boufounos | G01S 13/888 342/22 |
| 2015/0336097 | A1 | 11/2015 | Wang et al. | |
| 2015/0357710 | A1 | 12/2015 | Li et al. | |
| 2016/0091368 | A1 | 3/2016 | Fish et al. | |
| 2016/0170141 | A1 | 6/2016 | Luo et al. | |
| 2016/0172767 | A1 * | 6/2016 | Ray | G06F 17/5063 343/893 |
| 2016/0266414 | A1 | 9/2016 | Gill et al. | |
| 2016/0276803 | A1 | 9/2016 | Uesaka | |
| 2016/0285172 | A1 | 9/2016 | Kishigami et al. | |
| 2017/0041068 | A1 | 2/2017 | Murakowski et al. | |
| 2017/0131576 | A1 | 5/2017 | Gill et al. | |
| 2017/0315387 | A1 * | 11/2017 | Watts | G02B 6/1223 |
| 2018/0026721 | A1 | 1/2018 | Bock et al. | |
| 2018/0123699 | A1 | 5/2018 | Fatemi et al. | |
| 2018/0101032 | A1 | 6/2018 | Aflatouni et al. | |
| 2018/0101083 | A1 | 6/2018 | Aflatouni et al. | |
| 2018/0173025 | A1 | 6/2018 | McGreer et al. | |
| 2019/0056499 | A1 | 2/2019 | Fatemi et al. | |
| 2019/0089460 | A1 | 3/2019 | Khachaturian et al. | |
| 2021/0006333 | A1 * | 1/2021 | Morton | H01Q 3/2676 |

FOREIGN PATENT DOCUMENTS

| | | | |
|---|---|---|---|
| CN | 101889227 | A | 11/2010 |
| CN | 101282175 | B | 7/2012 |
| CN | 202915891 | U | 5/2013 |
| CN | 105814483 | A | 7/2016 |
| CN | 105917249 | A | 8/2016 |
| EP | 3094987 | A1 | 11/2016 |
| EP | 3094987 | B1 | 12/2018 |
| JP | H10500546 | A | 1/1998 |
| JP | 2016535243 | A | 11/2016 |
| WO | WO-2015105033 | A1 | 7/2015 |
| WO | WO 2018/148758 | A1 | 8/2018 |
| WO | WO 2018/165633 | A1 | 9/2018 |

OTHER PUBLICATIONS

U.S. Appl. No. 15/616,844, Non-Final Office Action dated Jun. 1, 2018.
WIPO Application No. PCT/US2018/018070, PCT International Search Report and Written Opinion of the International Searching Authority dated Apr. 27, 2018.
WIPO Application No. PCT/US2018/021882, PCT International Search Report and Written Opinion of the International Searching Authority dated Jun. 7, 2018.
Bogaerts, et al., "Low-loss, low-cross-talk crossings for silicon-on-insulator nanophotonic waveguides," *Optics Letters*, 32(19): 2801-2803, (2007).
Katz, et al., "Diffraction coupled phase-locked semiconductor laser array," *Appl. Phys. Lett.*, 42(7): 554-556, (1983).
Liang, et al., "Tiled-aperture coherent beam combining using optical phase-lock loops," *Electronics Letters*, 44(14), (2008).
Resler, et al., "High-efficiency liquid-crystal optical phased-array beam steering," *Opt. Lett.*, 21(9): 689-691, (1996).
Vaidyanathan, et al., "Sparse sensing with coprime arrays," Signals, Systems, and Computers (Asilomar) Conference, pp. 1405-1409, (2010).
Bliss, et al., "Multiple-Input Multiple-Output (MIMO) Radar and Imaging: Degrees of Freedom and Resolution," Signals, Systems, and Computers (Asilomar) Conference, pp. 54-59, (2003).
U.S. Appl. No. 15/616,844, Notice of Allowance dated Mar. 27, 2019.
U.S. Appl. No. 15/728,245, Final Office Action dated Dec. 6, 2019.
U.S. Appl. No. 15/728,245, Non-Final Office Action dated Apr. 17, 2019.
U.S. Appl. No. 15/728,329, Non-Final Office Action dated Jan. 30, 2019.
U.S. Appl. No. 15/728,329, Non-Final Office Action dated Sep. 9, 2019.
U.S. Appl. No. 15/917,536, Non-Final Office Action dated Aug. 7, 2019.
U.S. Appl. No. 15/917,536, Requirement for Restriction/Election dated Feb. 11, 2019.
WIPO Application No. PCT/US2018/018070, PCT International Preliminary Report on Patentability dated Aug. 13, 2019.
WIPO Application No. PCT/US2018/021882, PCT International Preliminary Report on Patentability dated Sep. 10, 2019.
U.S. Appl. No. 15/728,245, Non-Final Office Action dated Jun. 29, 2020.
U.S. Appl. No. 15/728,329, Notice of Allowance dated Jun. 12, 2020.
U.S. Appl. No. 15/896,005, Ex Parte Quayle Action mailed Apr. 29, 2020.
U.S. Appl. No. 15/917,536, Final Office Action dated May 14, 2020.
U.S. Appl. No. 15/728,245, Non-Final Office Action dated Mar. 2, 2021.
U.S. Appl. No. 15/971,536, Non-Final Office Action dated Nov. 25, 2020.
EP 18764449.7 EXtended Suroepean Search Report dated Nov. 24, 2020.
U.S. Appl. No. 15/616,844, Response to Non-Final Office Action filed Dec. 3, 2018.
U.S. Appl. No. 15/728,329, Final Office Action dated Aug. 3, 2018.

(56) References Cited

OTHER PUBLICATIONS

U.S. Appl. No. 15/728,329, Response to Non-Final Office Action filed Jul. 18, 2018.
Final Office Action dated Aug. 9, 2021 issued in U.S. Appl. No. 15/917,536.
Notice of Allowance dated Sep. 27, 2021 issued in U.S. Appl. No. 15/728,245.
U.S. Appl. No. 15/728,329, Response to Final Office Action filed Jan. 16, 2019.
Chinese Notice of Allowance dated Jun. 3, 2021, for Chinese Patent Application No. 201880016993.8 (with English traslation).
Chinese Office Action/Examination Report dated Sep. 2, 2020, for Chinese Patent Application No. 201880016993.8 (with English traslation).
JP Office Action dated Jan. 4, 2022, in Application No. JP2019-543993 with English translation.
U.S. Notice of Allowance dated Jan. 11, 2022, in U.S. Appl. No. 15/917,536.

* cited by examiner

TRX
TRX
TRX

Example 1D Array Co-Prime Phased Array Signal Processing with Homodyne Detection Architecture Fig. 21A
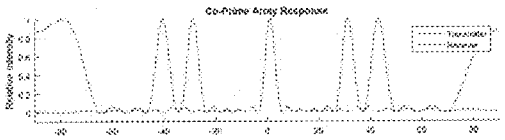
Fig 21B
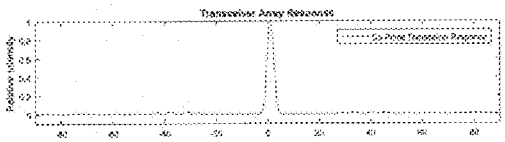
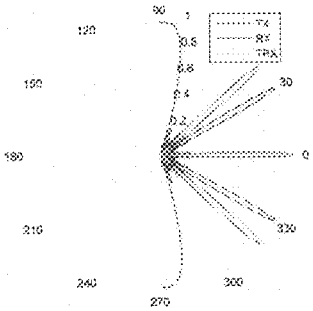
Fig. 22
Fig. 23A
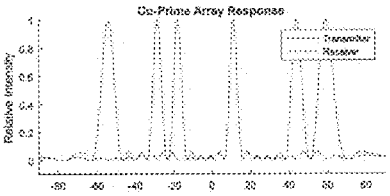
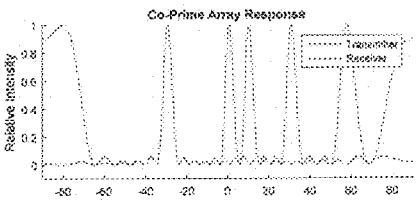
Fig. 24A
Fig. 23B
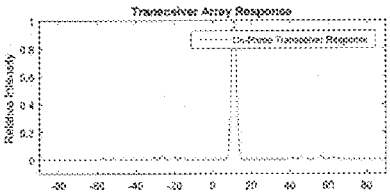
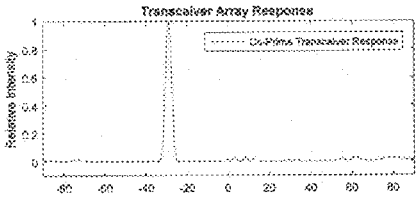
Fig 24B

MODULAR OPTICAL PHASED ARRAY

CROSS REFERENCE TO RELATED APPLICATIONS

The present application claims benefit under 35 USC 119(e) of application Ser. No. 62/331,586 filed May 4, 2014, the contents of which is incorporated herein by reference in its entirety.

FIELD OF THE INVENTION

The present invention relates to phased array, and more particularly to modular phased arrays.

BACKGROUND OF THE INVENTION

Optical phased arrays are used in shaping and steering a narrow, low-divergence, beam of light over a relatively wide angle. An integrated optical phased array photonics chip often includes a number of components such as lasers, photodiodes, optical modulators, optical interconnects, transmitters and receivers.

Optical phased arrays may be used in, for example, free-space optical communication where the laser beam is modulated to transmit data. Optical phased arrays have also been used in 3D imaging, mapping, remote sensing and other emerging technologies like autonomous cars and drone navigation. A need continues to exist for an optical phased array that has a larger aperture size and performance.

BRIEF SUMMARY OF THE INVENTION

A phased array, in accordance with one embodiment of the present invention, includes, in part, M×N photonic chips each of which includes, in part, an array of transmitters and an array of receivers; at least one of M or N is an integer greater than one. The transmitter arrays in each pair of adjacent photonics chips are spaced apart by a first distance and the receiver arrays in each pair of adjacent photonics chips are spaced apart by a second distance. The first and second distances are co-prime numbers. In one embodiment, at least a second subset of the M×N photonic chips is formed by rotating a first subset of the M×N photonic chips.

A phased array, in accordance with one embodiment of the present invention, includes, in part, at least first and second phased array sub-blocks. Each phased array sub-block includes, in part, M×N photonic chips each of which includes, in part, an array of transmitters and an array of receivers; at least one of M or N is an integer greater than one. The transmitter arrays in each pair of adjacent photonics chips in each phased array sub-block are spaced apart by a first distance and the receiver arrays in each pair of adjacent photonics chips in each phased array sub-block are spaced apart by a second distance. The first and second distances are co-prime numbers. In one embodiment, at least a second subset of the M×N photonic chips in each phased array sub-block is formed by rotating a first subset of the M×N photonic chips of that phased-array sub-block.

A phased array, in accordance with one embodiment of the present invention, includes, in part, a first M transceivers disposed along a first multitude of rows and columns, wherein each pair of adjacent transceivers of the first M transceivers is spaced apart by a first distance. The phased array further includes, in part, a second N transceiver arrays disposed along a second multitude of rows and columns, wherein each pair of adjacent transceivers of the second N transceivers is spaced apart by a second distance. The first and second distances are co-prime numbers. The first M transceivers and the second N transceivers include at least one common transceiver. At least one of M or N is an integer greater than one.

A method of forming a phased array, in accordance with one embodiment of the present invention, includes in part, forming a first array of photonic chips each of which includes, in part, an array of transmitters and an array of receivers. The transmitter arrays in each pair of adjacent photonics chips are spaced apart by a first distance. The receiver arrays in each pair of adjacent photonics chips are spaced apart by a second distance. The first and second distances are co-prime numbers. In one embodiment, the array is a two dimensional array. In one embodiment at least a second subset of the photonic chips is formed by rotating a first subset of the photonic chips A method of forming a phased array, in accordance with one embodiment of the present invention, includes in part, forming first and second arrays of photonic chips. Each photonic chip of the first array and/or the second array includes, in part, an array of transmitters and an array of receivers. The transmitter arrays in each pair of adjacent photonics chips in the first array are spaced apart by a first distance. The receiver arrays in each pair of adjacent photonics chips in the first array are spaced apart by a second distance. The first and second distances are co-prime numbers. The transmitter arrays in each pair of adjacent photonics chips positioned across the first and second arrays are spaced apart by the first distance. The receiver arrays in each pair of adjacent photonics chips positioned across the first and second arrays are spaced apart by the second distance.

A method of forming a phased array, in accordance with one embodiment of the present invention, includes in part, disposing a first M transceivers along a first multitude of rows and columns. Each pair of adjacent transceivers of the first M transceivers is spaced apart by a first distance. The method further includes, in part, disposing a second N transceiver arrays along a second multitude of rows and columns. Each pair of adjacent transceivers of the second N transceivers is spaced apart by a second distance. The first and second distances are co-prime numbers. The first M transceivers and the second N transceivers include at least one common transceiver. At least one of M or N is an integer greater than one.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 21A shows a computer simulation of exemplary radiation and response characteristics of each of transmitters and receivers of a phased array formed in accordance with one exemplary embodiment of the present invention.

FIG. 21B shows a computer simulation of a response characteristics of the receiver array associated with the phased array of FIG. 21A, in accordance with one exemplary embodiment of the present invention.

FIG. 22 shows the radiation and response patterns of FIGS. 21A and 21B in polar coordinates.

FIG. 23A shows a computer simulation of exemplary radiation and response characteristics of each of transmitters and receivers associated with the phased array of FIG. 21A after changing the direction of the light collection by nearly 10 degrees.

FIG. 23B shows a computer simulation of a response characteristics of the receiver array associated with the phased array of FIG. 21A after changing the direction of the light collection by nearly 10 degrees.

FIG. 24A shows a computer simulation of exemplary radiation and response characteristics of each of transmitters and receivers associated with the phased array of FIG. 21A after changing the direction of the light collection by nearly −30 degrees.

FIG. 24B shows a computer simulation of a response characteristics of the receiver array associated with the phased array of FIG. 21A after changing the direction of the light collection by nearly −30 degrees.

DETAILED DESCRIPTION OF THE INVENTION

Figure 1A:
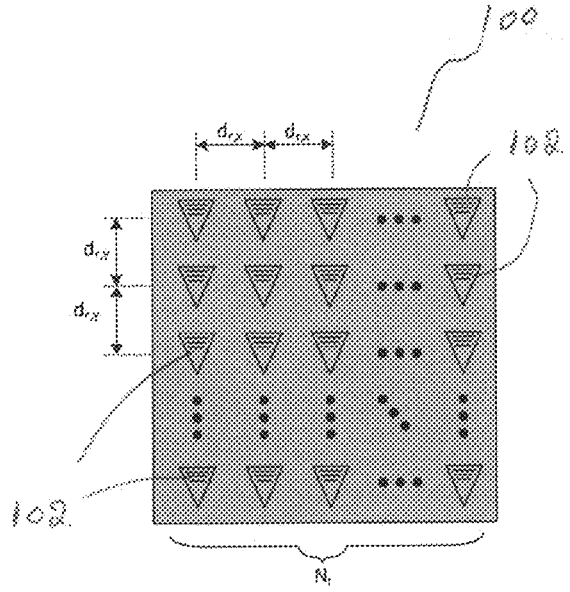
FIG. 1A shows an array of receiving elements of a receiver.
Figure 1B:
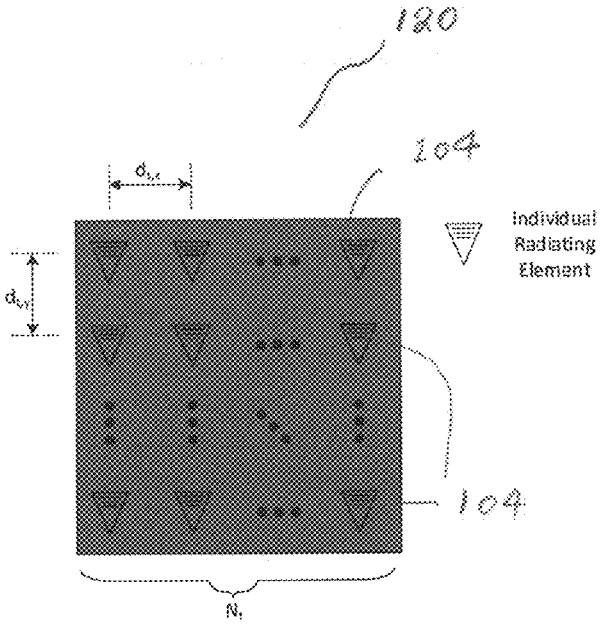
FIG. 1B shows an array of transmitting elements of a transmitter.

A co-prime phased array having $N_t \geq N$ transmitter elements with transmitter element spacing $d_t = Mx$, and $N_r \geq M$ receiver elements with receiver element spacing of $d_r = Nx$ generates an overall far-field pattern that will have only one main lobe if M and N are co-prime number with respect to each other. In each direction, the two distances are co-prime within a factor of x with respect to each other ($d_{r,x} = Nx$, $d_{t,x} = Mx$, $d_{r,y} = N'y$, $d_{t,y} = M'y$ where x,y are positive real numbers N and M are co-prime with respect to each other and N' and M' are co-prime with respect to each other). For simplicity, it is assumed herein that N'=N, M'=M, and x=y. FIG. 1A shows an array 100 of receiver elements 102 in which the distance between the receiver elements in the x and y direction is respectively shown as being equal to $d_{r,x}$ and $d_{r,y}$ respectively. FIG. 1B shows an array 120 of transmitter elements 104 in which the distance between the receiver elements in the x and y direction is respectively shown as being equal to $d_{t,x}$ and $d_{t,y}$ respectively.

In accordance with one aspect of the present invention a phased array is formed in a modular fashion, such that, the transmitter and receiver elements have spacing greater than $\lambda/2$ but the overall pattern of the co-prime transceiver suppresses all the side-lobes. For integrated photonic process with single layer of optical routing, this techniques allows for the creation of larger phased arrays. Spacing $d_r$ and $d_t$ between the radiating elements creates sufficient room to do optical routing to and from the radiating elements to the rest of the photonic components on the chip. As the number of elements in the phased array increases ($N_t$, $N_r$) the spacing of the elements also increases in a phased array which creates more room for optical routing. As a consequence, very large phased array can be created on a single chip.

In a photonic phased array with single layer of optical routing, a significant portion of the chip area is dedicated to other required components in the phased array such as coherent sources and detectors, photonic modulators, and tuners, electrical contact pads, and control circuits, thereby limiting the maximum size of an integrated photonic aperture. In accordance with embodiments of the present invention, such limitations are overcome to create an integrated photonic phased arrays of any size in a modular form.

In accordance with one embodiment, different photonic phased array chips are tiled together to form a larger sub-block in which the transmitter and receiver arrays of individual chips are spaced in a co-prime fashion. In accordance with another embodiment, such sub-blocks are tiled together in a MIMO fashion where the transmitter of one-block is used to capture an image in conjunction with the receiver of another block to form a larger aperture.

In accordance with one embodiment of the present invention, a multitude of transceiver photonic chips, each with a different spatial placement of transmitter and receiver blocks, are combined in a simple, reliable and modular form to generate a larger optical phased array. In other words, in accordance with embodiments of the present invention, the aperture size of a phased array is selected by grouping/tiling together a set of transceiver photonics chips each of which has a different spatial arrangement of transmitter and receiver blocks.

As is known, a uniform 1-dimensional array of N optical transmitter/receiver elements forming an optical phased array, in which the distance between adjacent elements is $x_k=kd_x$ (k=0, 1, . . . N), may reconstruct the $$[-\frac{\pi}{2}, \frac{\pi}{2}]$$

field of view up to the spatial frequency resolution bandwidth defined by the largest spacing of $x_N=Nd_x$ if $d_x$ is equal to half the bandwidth a, of the optical wavelength. Such an optical phased array may include N transmitter elements (spaced apart from one another by $Md_x$) and M receiver elements (spaced apart from one another by $Nd_x$), where M and N are co-prime numbers. The spacing between the transmitting or receiving elements is alternatively referred to herein as element spacing.

A phased array with $X\lambda/2$ element spacing has a total of X lobes. Therefore, the transmitters of the above-described phased array illuminate the target at M $(2d_x/\lambda)$ points, and the receivers capture the signals from N $(2d_x/\lambda)$ points. However, because the number of transmitters and receivers is a co-prime pair, the receiver collect light from one of the illuminated points for any given relative phase between transmitter and receiver.

In frequency domain, obtained using the Fourier transform, a co-prime array may reconstruct the spatial frequency as shown below:

$$x_k=(Ma_1-Na_2)d_x$$

where M and N are co-prime numbers representing the number of transmitters and receivers respectively, $\alpha_1$ is a member of a set defined by $\alpha_1\in[0,1, \ldots, 2N-1]$, $\alpha_2$ is a member of a set defined by $\alpha_2\in[0, 1, \ldots, M-1]$ In accordance with one embodiment of the present invention, a multitude of silicon photonic chips each of which includes at least one optical transmitter and at least one optical receiver are placed alongside each other to form a rectangular optical phased array. The placement of the transceiver chips is done such that the distance between each adjacent pair of optical receivers is a co-prime of the distance between each adjacent pair of optical transmitters, as described further below.

Figure 2:
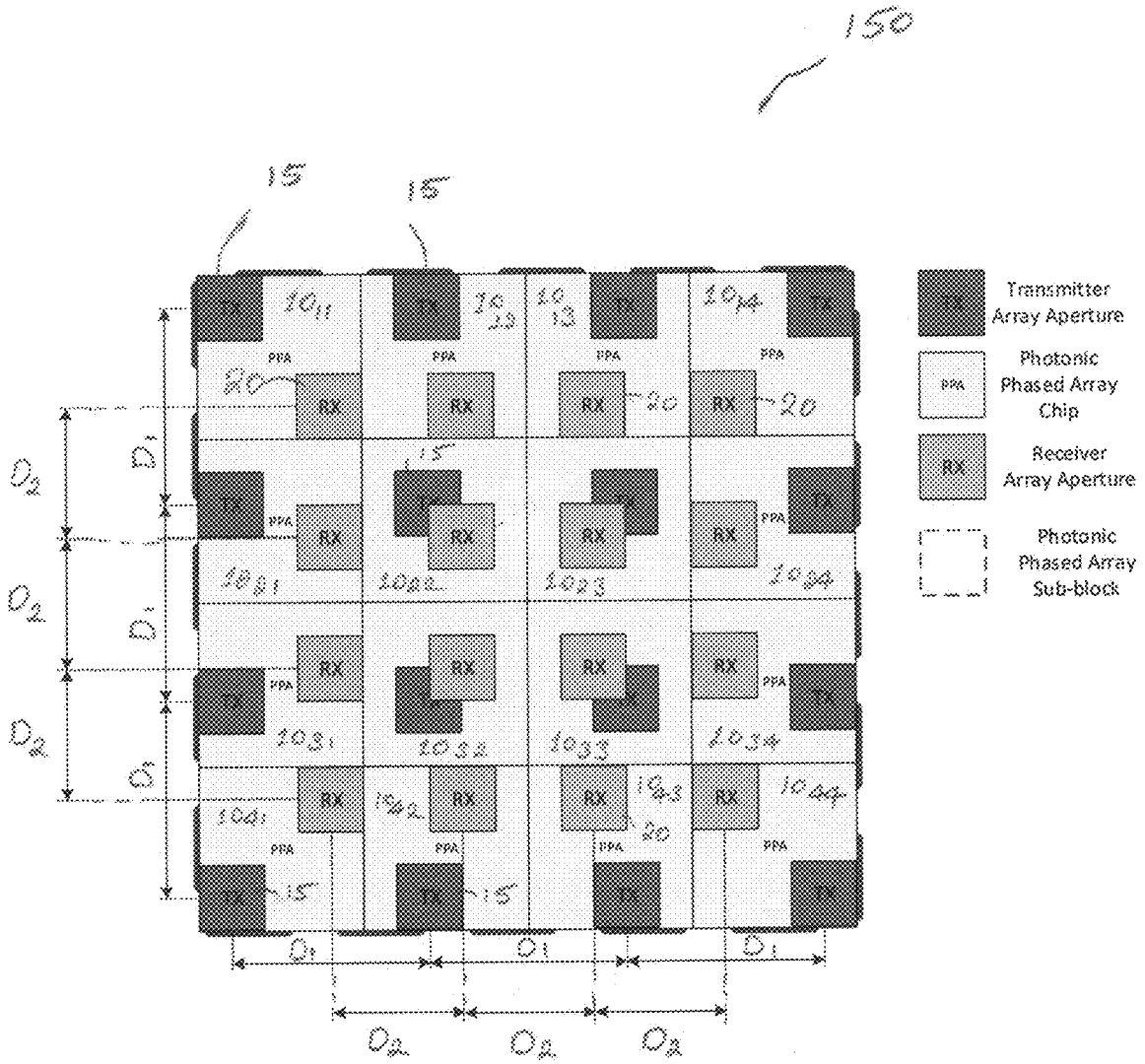
FIG. 2 is an optical phased array formed in accordance with one exemplary embodiment of the present invention.
Figure 3:
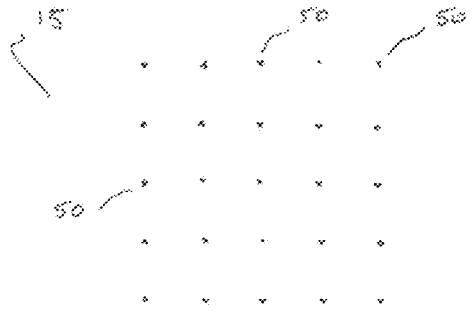
FIG. 3 shows an exemplary 5×5 array of transmitting elements forming an exemplary transmitter.
Figure 4:
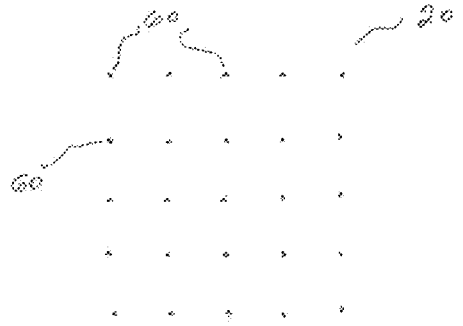
FIG. 4 shows an exemplary 5×5 array of receiving elements forming an exemplary receiver.

FIG. 2 is an optical phased array 150 formed using 16 transceiver chips $\mathbf{10}_{ij}$, where i refers to the row number in which the transceiver chip is disposed and ranging from 1 to 4, and j refers to the column number in which the transceiver chip is disposed ranging from 1 to 4, in accordance with one exemplary embodiment of the present invention. In one example, each transceiver chips $\mathbf{10}_{ij}$ has a length and width of 1 mm. Each transceiver chip $\mathbf{10}_{ij}$ is shown as including a transmitter 15 and a receiver 20. It is understood that each transmitter 15 or receiver 20 may be a one-dimensional or a two-dimensional array of transmitters. FIG. 3 shows an exemplary 5×5 array of transmitting elements 50 forming an exemplary transmitter 15. FIG. 4 shows an exemplary 5×5 array of receiving elements 60 forming an exemplary receiver 20. The distance between each pair of adjacent transmitting elements 50, or each pair of adjacent receiving elements 60 may be by an integer multiple of the half of the wavelength of the optical signals transmitted by the transmitting elements. In one example, the wavelength of the optical signal transmitted by each transmitting element is 1.55 μm. In other embodiments, however, the distance between each pair of adjacent transmitting elements 50, or each pair of adjacent receiving elements 60 may be different than an integer multiple of the half of the wavelength of the optical signals transmitted by the transmitting elements.

In the above example, each transceiver chip $\mathbf{10}_{ij}$ is assumed to have a square shape. It is further assumed that transmitter 15 and receiver 20 of each transceiver chip $\mathbf{10}_{ij}$ also have square shapes, as shown. Transmitters 15 of the different transceiver chips are spatially positioned such that the distance between each pair of adjacent transceiver, such as between transmitters 15 of adjacent transceiver chips $\mathbf{10}_{11}/\mathbf{10}_{12}$, or $\mathbf{10}_{11}/\mathbf{10}_{21}$, or $\mathbf{10}_{23}/\mathbf{10}_{24}$, and the like, as measured, in this example, from the centers of their square shapes have the same distance $D_1$. In a similar manner, receiver 20 of the different transceiver chips are spatially positioned such that the distance between each pair of adjacent receivers, such as between receivers 20 of adjacent transceiver chips $\mathbf{10}_{11}/\mathbf{10}_{12}$, or $\mathbf{10}_{11}/\mathbf{10}_{21}$, or $\mathbf{10}_{23}/\mathbf{10}_{24}$, and the like, as measured, in this example, from the centers of their square shapes have the same distance $D_2$, which in the example shown in FIG. 1 is smaller than $D_1$. In accordance with one aspect of the present invention, distances $D_1$ and $D_2$ are co-prime numbers. As is seen from FIG. 1, transmitter 15 and receiver 20 of each transceiver chips $\mathbf{10}_{22}$, $\mathbf{10}_{23}$, $\mathbf{10}_{32}$ and $\mathbf{10}_{33}$ partially overlap one another. However, transmitters 15 of different transcery chips do not overlap one another. It is understood that such distances may be measure between any two points in two differnt arrays if the two points substantilly identifry similar locations in the two arrays.

As is seen from FIG. 2, for each row i, transceiver chip $\mathbf{10}_{i4}$ may be formed by rotating transceiver chip $\mathbf{10}_{i1}$ 180° about the y-axis. For example, by rotating transceiver chip $\mathbf{10}_{11}$ 180° about the y-axis, transceiver chip $\mathbf{10}_{14}$ is obtained. Likewise, by rotating transceiver chip $\mathbf{10}_{31}$ 180° about the y-axis, transceiver chip $\mathbf{10}_{34}$ is obtained. Similarly, for each row i, transceiver chip $\mathbf{10}_{13}$ may be formed by rotating transceiver chip $\mathbf{10}_{12}$ 180° about the y-axis. For example, by rotating transceiver chip $\mathbf{10}_{12}$ 180° about the y-axis, transceiver chip $\mathbf{10}_{13}$ is obtained. Likewise, by rotating transceiver chip photonic chip $\mathbf{10}_{32}$ 180° about the y-axis, transceiver chip $\mathbf{10}_{33}$ is obtained.

As is further seen from FIG. 2, for each column j, transceiver chip $\mathbf{10}_{4j}$ may be formed by rotating transceiver chip $\mathbf{10}_{1j}$ 180° about the x-axis. For example, by rotating transceiver chip photonic chip $\mathbf{10}_{11}$ 180° about the x-axis, transceiver chip $\mathbf{10}_{41}$ is obtained. Likewise, by rotating transceiver chip photonic chip $\mathbf{10}_{13}$ 180° about the x-axis, transceiver chip $\mathbf{10}_{43}$ is obtained. Similarly, for each column j, transceiver chip $\mathbf{10}_{3j}$ may be formed by rotating transceiver chip $\mathbf{10}_{2j}$ 180° about the y-axis. For example, by rotating transceiver chip $\mathbf{10}_{21}$ 180° about the x-axis, transceiver chip $\mathbf{10}_{31}$ is obtained. Likewise, by rotating transceiver chip $\mathbf{10}_{22}$ 180° about the x-axis, transceiver chip $\mathbf{10}_{33}$ is obtained. Therefore, phased array 100 may be formed by grouping and tiling of four identical sets of transceiver chips $\mathbf{10}_{11}$, $\mathbf{10}_{12}$, $\mathbf{10}_{21}$, and $\mathbf{10}_{22}$ after the rotations described above. In other words, only 4 different transceiver chip layout are required to form the 16×16 two-dimensional arrays of transmitters/receivers of phased array 100. Since the quadrants are rotationally symmetric, a first quadrant can be used to form the other 3 quadrants by rotating the first quadrant 90, 180, and 270 degrees. For example, a 6×6 photonic sub-block, consisting of 36 photonic phased array chips requires only 9 different variations of the photonic phased array chip since the remaining chips are simply the rotations of the first 9 chips. Consequently, in accordance with embodiments of the present invention and as described above, by using a multitude of signle trasceiver chips each having a 1 mm by 1 mm aperture, an optical phased array with a significantly larger aperture is formed.

Figure 5:
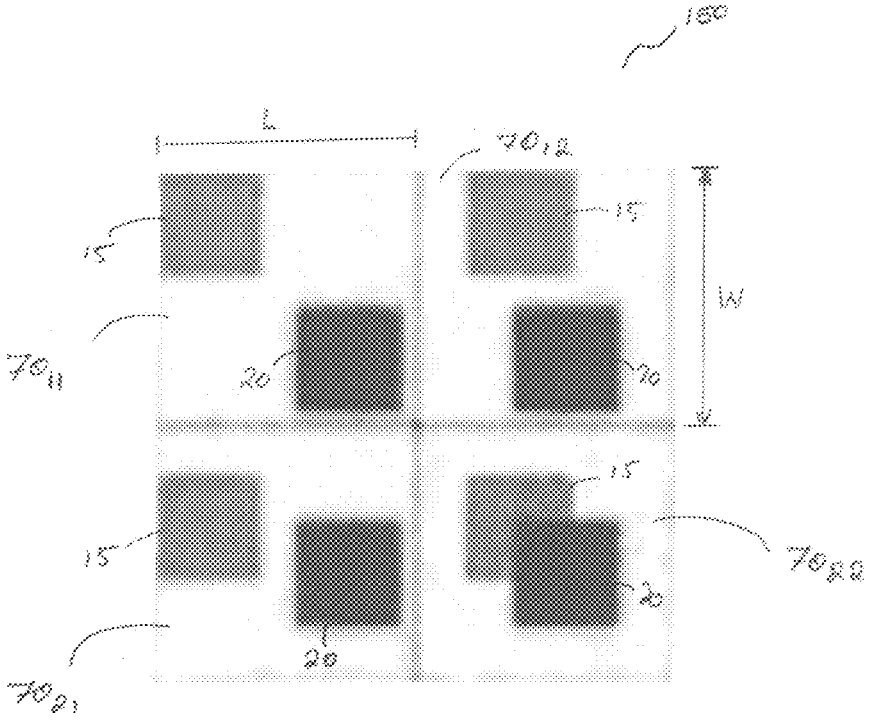
FIG. 5 shows a phased array formed using 4 transceiver chips, in accordance with one exemplary embodiment of the present invention.

FIG. 5 shows a phased array 150 formed using 4 transceiver chips $\mathbf{70}_{11}$, $\mathbf{70}_{12}$, $\mathbf{70}_{21}$, and $\mathbf{70}_{22}$, in accordance with another exemplary embodiment of the present invention. Transceiver chips $\mathbf{70}_{11}$, $\mathbf{70}_{12}$, $\mathbf{70}_{21}$, and $\mathbf{70}_{22}$ correspond to transceiver chips $\mathbf{10}_{11}$, $\mathbf{10}_{12}$, $\mathbf{10}_{21}$, and $\mathbf{10}_{22}$ of FIG. 1. Each of transceiver chips $\mathbf{70}_{11}$, $\mathbf{70}_{12}$, $\mathbf{70}_{21}$, $\mathbf{70}_{22}$ includes a transmitter 15 and a receiver 20, each of which may include a one-dimensional or a two-dimensional array of transmitting or receiving elements, as shown, for example, in FIGS. 3 and 4. As was described above with reference to FIG. 2, phased array 150 that includes a 16×16 arrays of transmitters and receivers may be formed by rotating and tiling together of the four transceiver chips shown in FIG. 5.

Figure 6:
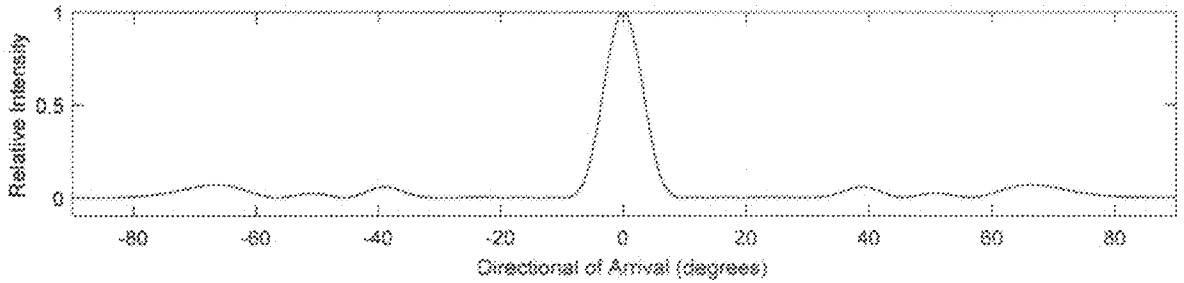
FIG. 6 is a computer simulation of a response of the phased array shown in FIG. 2.

Assume each of transceiver chips $\mathbf{70}_{11}$, $\mathbf{70}_{12}$, $\mathbf{70}_{21}$, $\mathbf{70}_{22}$ has a length L of 2.5 mm, and a width W of 2.5 mm. Accordingly, phased array 150 has a length of 10 mm and a width of 10 mm. Assume that the distance $D_1$ between the centers of each pair of adjacent transmitters is 3 mm, and the distance $D_2$ between the centers of each pair of adjacent receivers is 2.1 mm. Because distances $D_1$ and $D_2$ are prime numbers, in accordance with embodiments of the present invention, phase array 150 has an improved performance characteristic. FIG. 2 shows computer simulation results of the response of phased array 150. As is seen from FIG. 6, phased array 150 has a main lobe near the center and side lobes that are substantially degraded; shown as being less than −11 dB.

Figure 20:
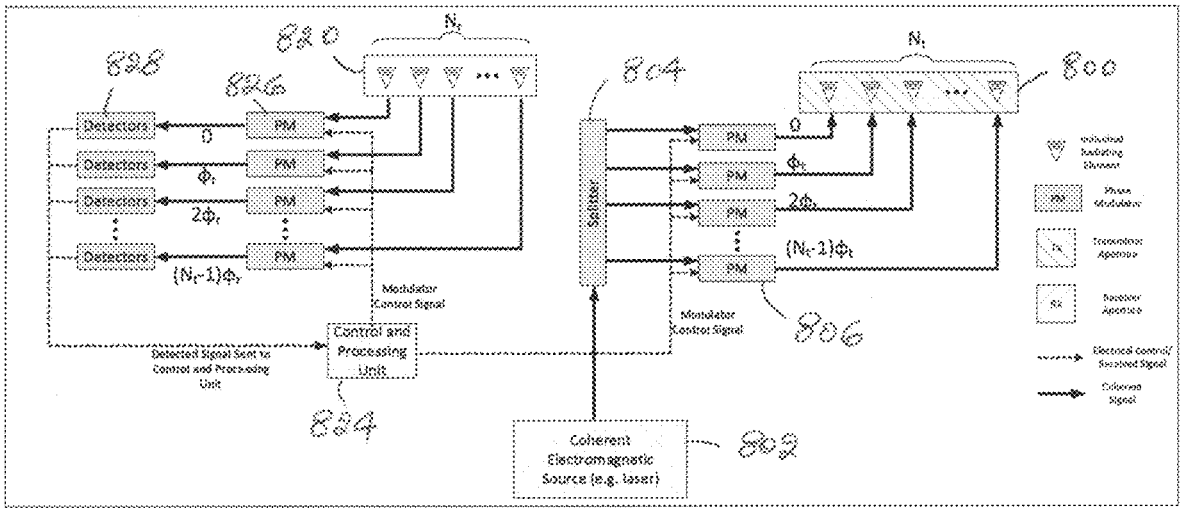
FIG. 20 is a simplified schematic block diagram of a one-dimensional transceiver array having N transmitters and receivers, in accordance with one exemplary embodiment of the present invention.

FIG. 20 is a simplified schematic block diagram of a one-dimensional transceiver array having N transmitters $N_t$ and receivers $N_r$. The optical signal generated by coherent electromagnetic source 802 is split into N signals by splitter 804, each of which is phase modulated by a different one of phase modulators (PM) 806 and transmitted by a different one of the transmitters, collectively identified using reference number 800. The signals received by receivers 820 are modulated in phase by PMs 826 the reflected signals and detected by detectors 828. The output signals of the detectors is received by control and processing unit 824 which, in turn, controls the phases of PMs 806 and 826.

A co-prime transmitter and receiver pair will each have several side-lobes. However, their combined radiation pattern will only have one main lobe. Each transmitter and receiver need to be set such that the relative phase between the elements is linearly increasing. Assume that the relative phase steps of the transmitters is $\phi_t$ and relative phase step of receivers is $\phi_r$. As a result, the transmitter and receiver phased array will have the center-lobe pointing in a specific direction which are uncorrelated with respect to each other. However, their combined radiation pattern will have one main lobe. If $\phi_t$ and $\phi_r$ are swept from zero to 2 π, the combined main-lobe will be swept across the field of view as well. The combined main-lobe has the maximum amplitude when any two of the transmitter and receiver main lobe are aligned in substantially the same direction.

Therefore, by setting a linear phase delay step between the elements of each of the transmitters and the receivers, and slowly varying the phase delay step of either the transmitters or the receivers, a co-prime phased array that has a single main lobe and can sweep the entire field of view is achieved.

In the one-dimensional array shown in FIG. 20, the control and processing unit 802 adjusts the relative phase between the elements using the phase modulators such that the receiver elements have linear relative phase difference of $(0, \phi_r, 2\phi_r, 3\phi_r, \ldots, (N_r-1)\phi_r)$ and the transmitter elements have linear relative phase difference of $(0, \phi_t, 2\phi_t, 3\phi_t, \ldots, (N_t-1)\phi_t)$. It is understood that $\phi_r$, $\phi_t$ can have any value in the range of [0, 2 π].

The resulting transceiver has a response as shown in FIG. 21B. In this example and as shown in FIG. 21A, each of the transmitters and receivers is shown as having 4 radiation lobes. However, due to the co-prime nature of the transmitter/receiver array, their combined response has only one lobe. The transmitter illuminates several points on the target and the receiver collects light from several directions but at any given setting the receiver only collects light from one of the illuminated points by the transmitter. FIG. 22 shows the radiation patterns of FIGS. 21A and 21B in polar coordinates.

To change the directional of light collection for the co-prime array, that is to steer the transceiver array lobe across the field of view, one of two things can be done. If one were to change the values of $\phi_r$ to $\phi'_r=\phi_r+d\phi$ and $\phi'_t=\phi_t+d\phi$, the directional of the received light would change as shown in images below. In FIG. 23A, $d\phi>0$ corresponding to 10 degree change in the direction of light collection with respect to the FIG. 21A. In FIG. 24A, $d\phi<0$ corresponding to −30 degree change in the direction of light collection with respect to the FIG. 21A. Therefore, by changing the value of $d\phi$ it is possible to steer the entire field of view.

Figure 25:
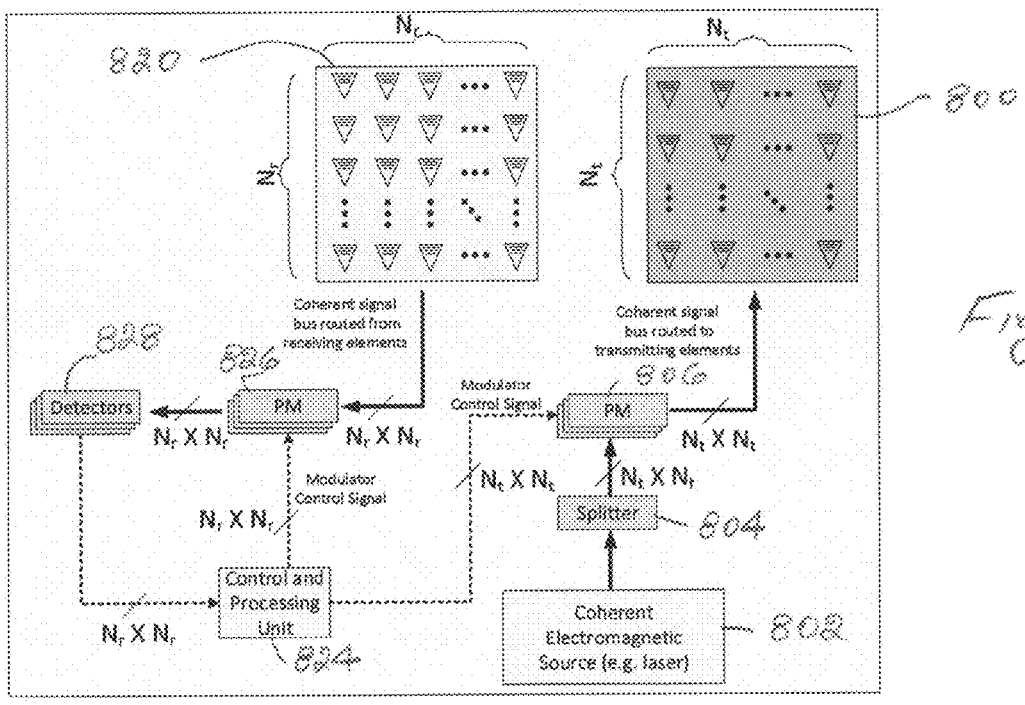
FIG. 25 is a homodyne two-dimensional phased array, in accordance with one exemplary embodiment of the present invention.
Figure 26:
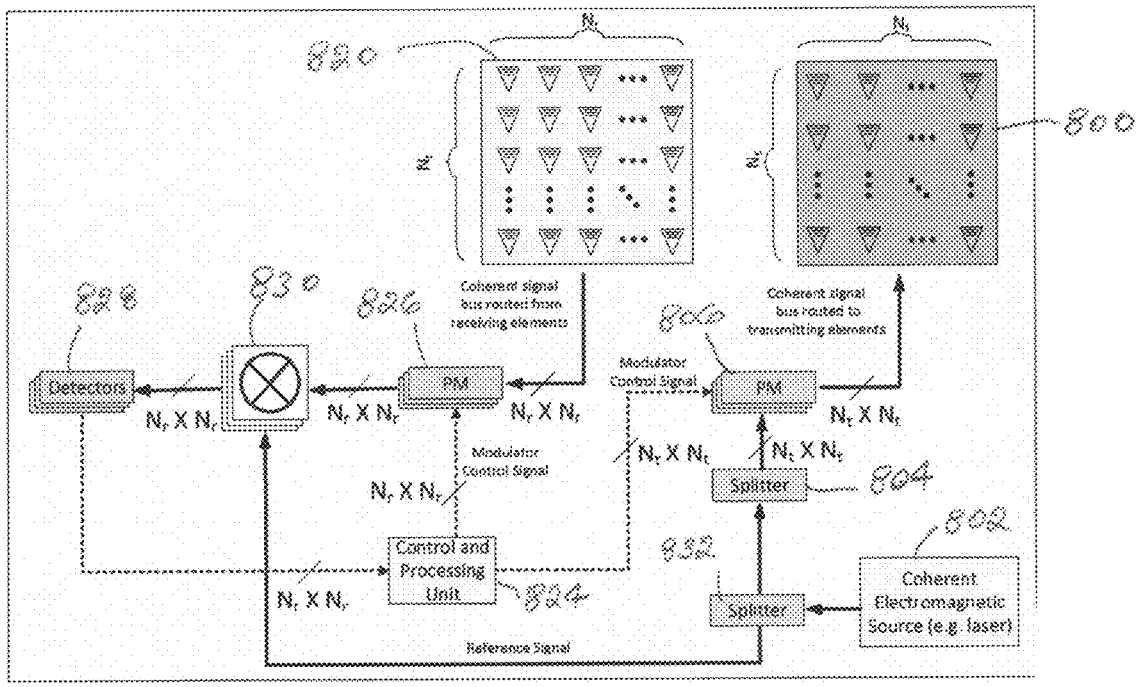
FIG. 26 is a heterodyne two-dimensional phased array, in accordance with one exemplary embodiment of the present invention.

FIG. 25 is a simplified schematic block diagram of a two-dimensional transceiver array having an array of $N_t \times N_t$ transmitters and an array of $N_r \times N_r$ receivers. The two-dimensional transceiver shown in FIG. 25 has a homodyne architecture but is otherwise similar to the one-dimensional transceiver shown in FIG. 20. FIG. 26 is a simplified schematic block diagram of a heterodyne two-dimensional transceiver array having an array of $N_t \times N_t$ transmitters and an array of $N_r \times N_r$ receivers. The two-dimensional transceiver architecture shown in FIG. 26 is also shown as including an additional splitter 832 and a multitude of mixers 830. The signal detection scheme described above is also applicable to both homodyne as well as heterodyne array architectures.

Figure 7:
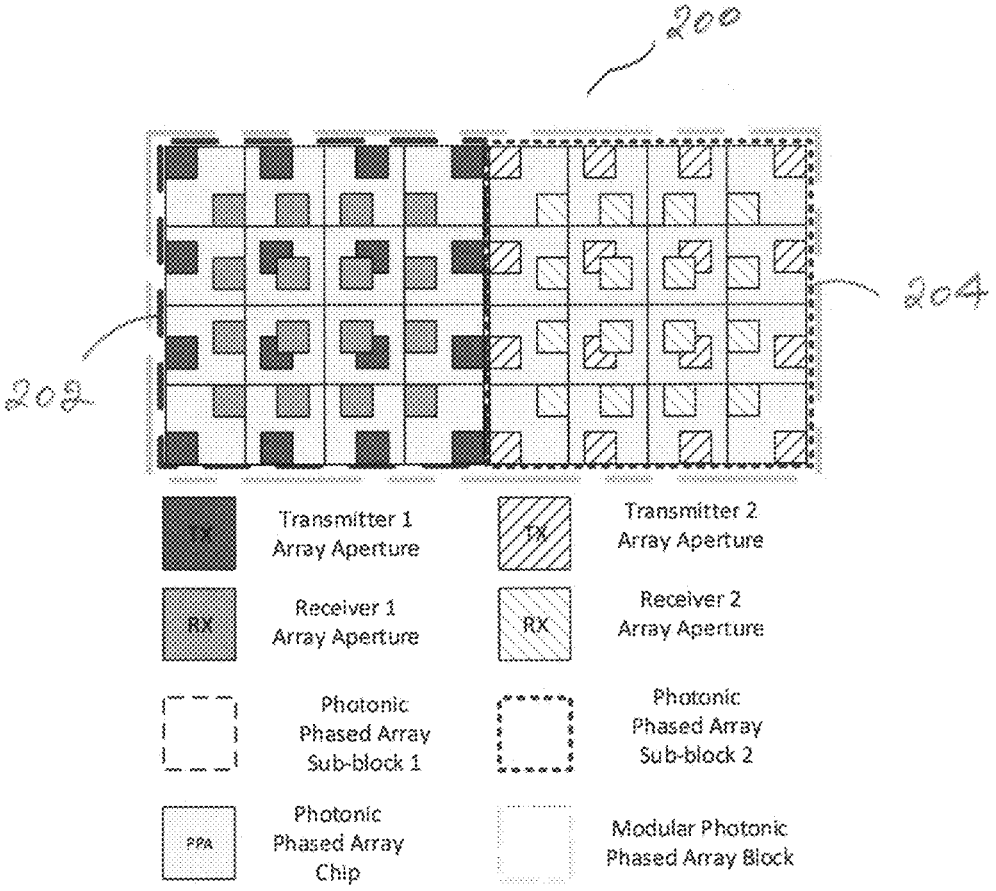
FIG. 7 is an exemplary 1×2 phased array that includes two similar phased array sub-blocks, in accordance with one exemplary embodiment of the present invention.

In accordance with another embodiment of the present invention, to form a phased array of any size and reduce the number of chips with different layouts, photonic phased array sub-blocks are tiled together in a modular format. FIG. 7 is an exemplary 1×2 phased array 200 that includes two identical photonic phased array sub-blocks 202 and 204. Each of sub-blocks 202 and 204 corresponds to phased array 150 shown in FIG. 2. In other words, phased array 200 is formed by tiling together of two identical phased array 150 of FIG. 2. In phased array 200, the transmitter array from sub-block 202 forms a co-prime array with (i) the receiver array in sub-block 202, as well as (ii) with the receiver array of sub-block 204. Accordingly, the aperture size of a phased array camera, in accordance with embodiments of the present invention may be increased to any selected size.

Figures 8A, 8B:
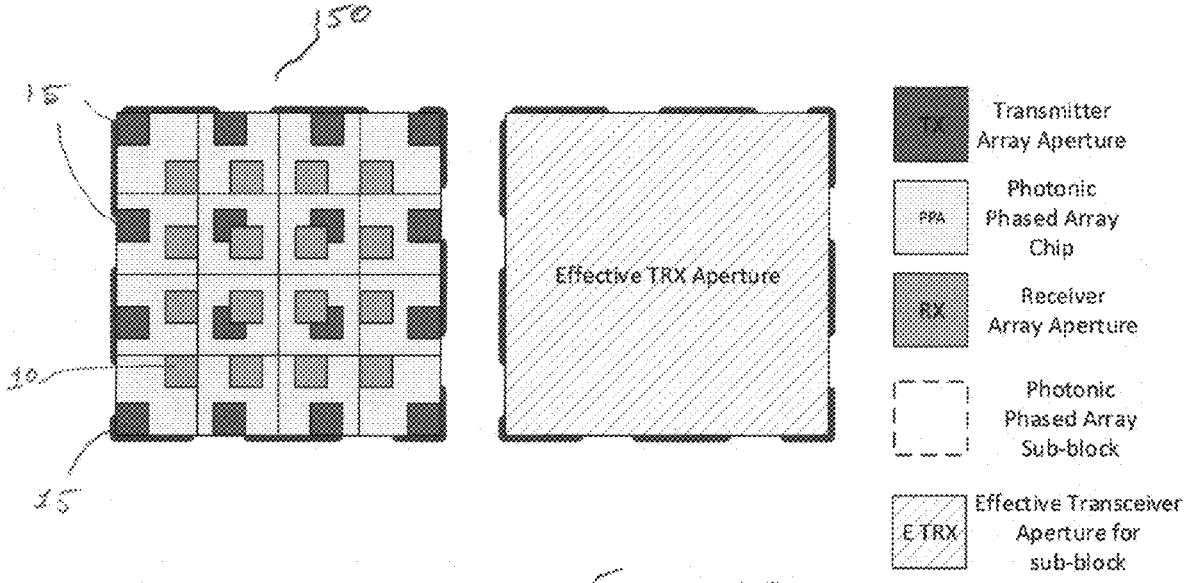
FIG. 8A shows the phased array of FIG. 2.
FIG. 8B shows the effective transmitter/receiver array aperture size of the phased array of FIG. 8A

FIG. 8A shows phased array 150 of FIG. 2 which is alternatively referred to herein as a phased array sub-block 150 and that is used to form a larger phased array of with a selected aperture size, as described further below. FIG. 8B shows the effective transmitter/receiver array aperture size of the phased array of FIG. 8A.

Figure 9:
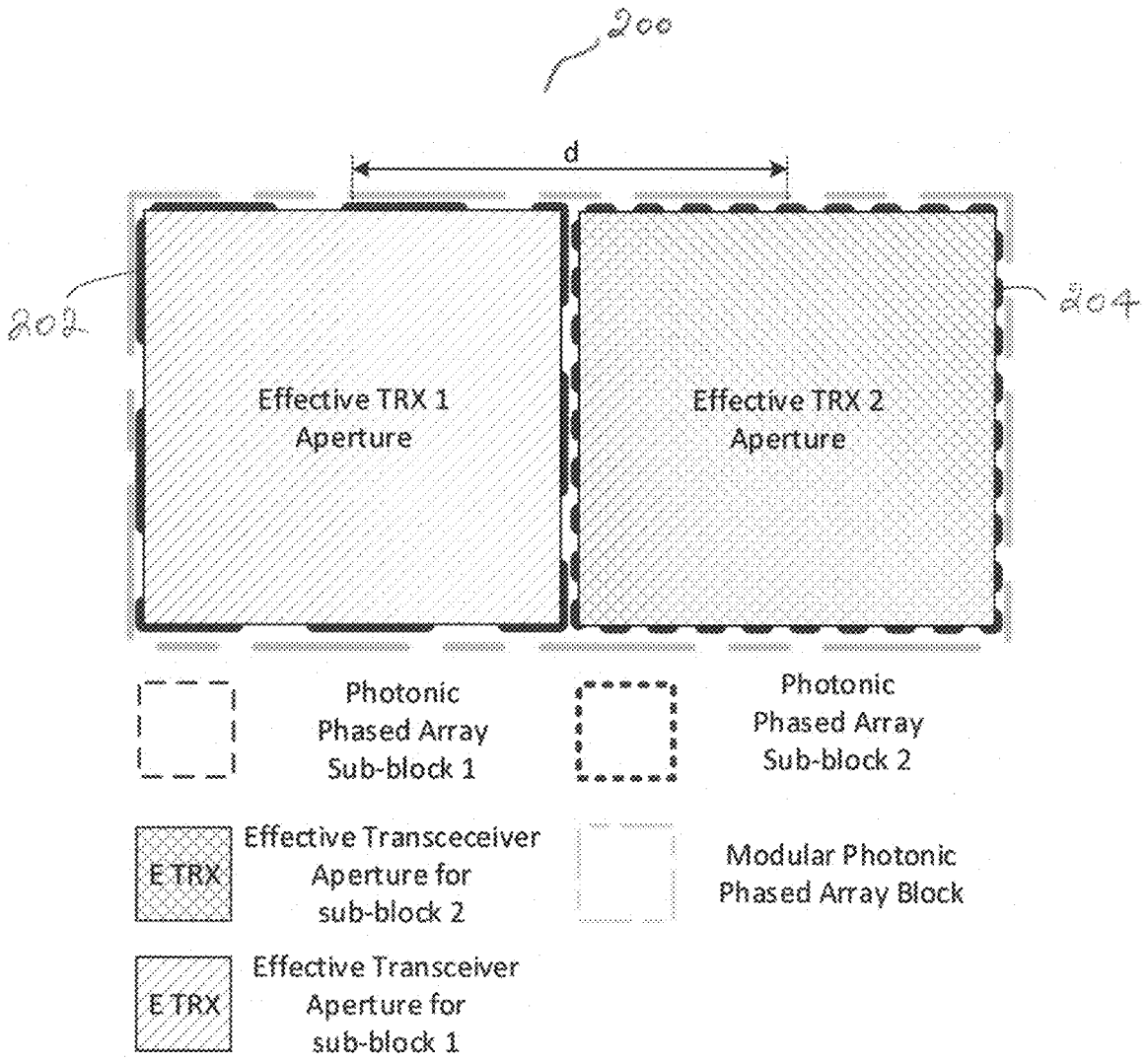
FIG. 9 shows the effective transmitter/receiver array aperture sizes of the phased-array sub-blocks together forming the phased array of FIG. 7.

FIG. 9 shows the effective transmitter/receiver array aperture sizes of phased-array sub-blocks 202 and 204 which together form phased array 200, as also shown in FIG. 7. For a single photonic phased array, the transmitter and receiver response may be modeled as:

$$R_1 = I(\phi)T_1$$

where $\phi = kd\sin(\theta)$ and d is the spacing between transmitter or receiver elements, $\theta$ is the angle of the arrival of the coherent electromagnetic wave, and $I(\phi)$ is the intensity response of the target being imaged.

Figure 10:
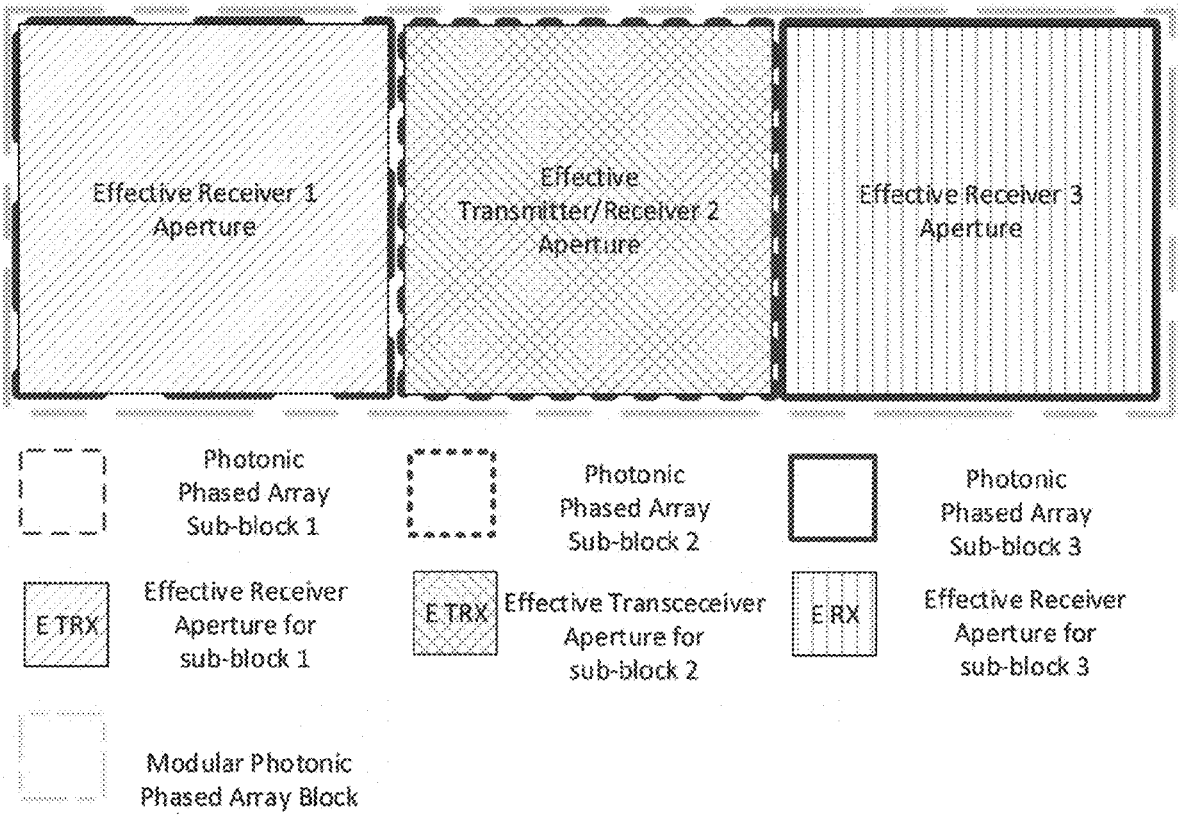
FIG. 10 shows a phased array having a response characteristic equivalent to that of the phased array shown in FIG. 9.

For a 1×2 array as shown in FIGS. 7 and 9, the transmitter and receiver response may be described as:

$$\begin{pmatrix} R_1 \\ R_2 \end{pmatrix} = I(\phi)\begin{pmatrix} 1 & e^{j\phi} \\ e^{j\phi} & e^{j2\phi} \end{pmatrix}\begin{pmatrix} T_1 \\ T_2 \end{pmatrix}$$

where $T_1$, $R_1$, $T_2$, $R_2$ are the coherent wave transmitted and received by sub-block 202 and 204. The far field pattern may be measured using the transmitter of the first sub-block and the receiver of the first block. Then the far field pattern may be measured using the transmitter of the first block, and receiver of the second block. This operation is repeated for transmitter of the second block and using receivers of the first and second blocks. The results of these measurements are then combined by an algorithm using, for example, a digital control circuit, to determine the response of the larger phased array 200. The response and performance characteristic of phased array 200 is equivalent to the response of phased array 250 shown in FIG. 10 that has the following phase relationship between its transmitter and receivers:

$$(R_1\ R_2\ R_3)^T = I(\phi)(1\ e^{j\phi}\ e^{j2\phi})^T(T_1)$$

For the embodiments described with reference to FIGS. 7-10, the reconstruction of the received signal is done in the digital domain and as follows. In such embodiments, any desired transmitter group in a given sub-block should be able to turn on and off. The individual radiating elements on the chips have linear phase relationship defined by $\Phi_{chip}=(0, \phi_r, 2\phi_r, 3\phi_r, \ldots, (N_r-1)\phi_r)$ for each receiving element in each direction. It is assumed that $\phi_r$ is relative phase between elements and $N_r$ is the number of elements within each aperture. In addition, the sub-block will have linear phase relationship defined by $\Phi_{subblock}=(0, \phi_b, 2\phi_b, \ldots, (N_{sb}-1)\phi_b)$. It is assumed that $\phi_b$ is relative phase between apertures in different sub-blocks and $N_{sb}$ is the number of radiating apertures in the sub-blocks.

Each modular block will also have linear phase increments. The phase relationship is defined by $\Phi_{modular\ tile}=(0, \phi_m, 2\phi_m, \ldots, (N_m-1)\phi_m)$. It is assumed that $\phi_m$ is the relative phase between apertures in different modular blocks and $N_m$ is the number of modular blocks. In such a tiling scheme, all transmitters and all receivers are paired together and are used for capturing image. Each pair collects a fraction of the transmitted or received light. The signals from sub-blocks in such tiling schemes are reconstructed in the digital domain.

In a coherent transceiver system, the receiver aperture effectively sees the Fourier transform of the reflected object. Each co-prime sub-block with single main-lobe collects the spatial frequency components of the signal reflected from the targets equal to the aperture bandwidth. A MIMO architecture with several sub-blocks after reconstruction in digital domain equals to a larger aperture. By pairing various transmitters and receiver blocks, a block of spatial frequency components (equal to bandwidth of each aperture) is captured at different times and then combined in a digital signal processing block.

In contrast to the first two methods were signal from sub-blocks are collected in real time, signals from sub-blocks in MIMO scheme are reconstructed in the digital domain.

Figures 11, 12:
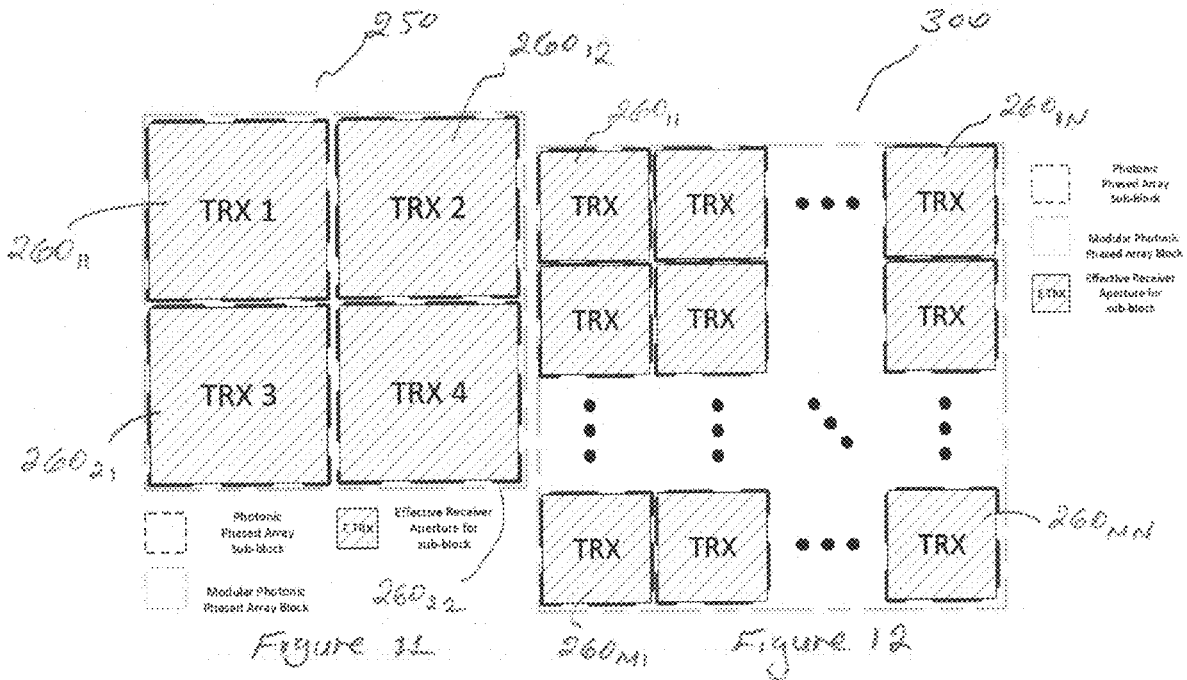
FIG. 11 shows an exemplary 2×2 phased array, in accordance with one exemplary embodiment of the present invention.
FIG. 12 shows an exemplary M×N phased array, in accordance with one exemplary embodiment of the present invention.
Figure 13:
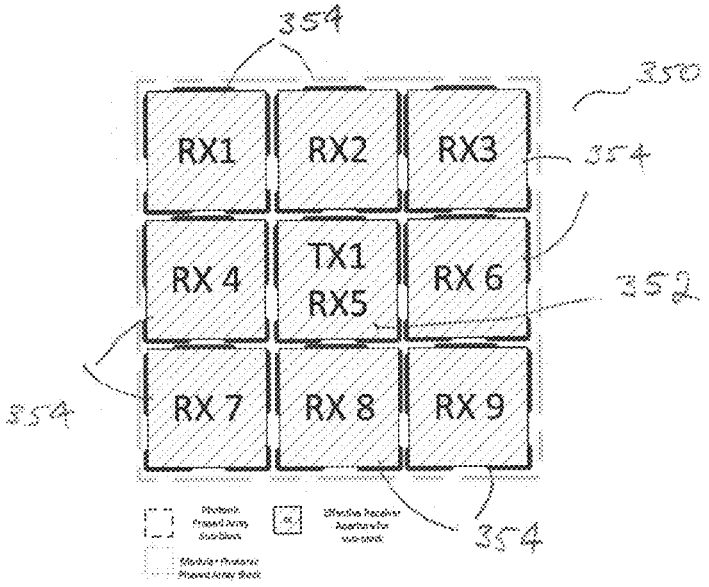
FIG. 13 shows a phased array having a response characteristic equivalent to that of the phased array shown in FIG. 11.

FIG. 11 shows an exemplary 2×2 photonic phased array 250 that includes sub-blocks $\mathbf{260}_{11}$, $\mathbf{260}_{12}$, $\mathbf{260}_{21}$ and $\mathbf{260}_{22}$ each of which sub-clocks corresponds to phased array 150 shown in FIG. 8A. Photonic phased array 250 is equivalent to photonic phased array 350 shown in FIG. 13 that has one transmitter/receiver (transceiver) 352 sub-block and 8 receiver sub-blocks 354 and in which one the transmitter's emission is measured using the 9 receivers. FIG. 12 shows an exemplary M×N photonic phased array 300 that includes M×N sub-blocks $\mathbf{260}_{k1}$, where k is a row index ranging from 1 to M and 1 is a column index ranging from 1 to N. Accordingly, using embodiments of the present invention, a phased array of an arbitrary transmitter/array aperture size may be formed.

Figure 14:
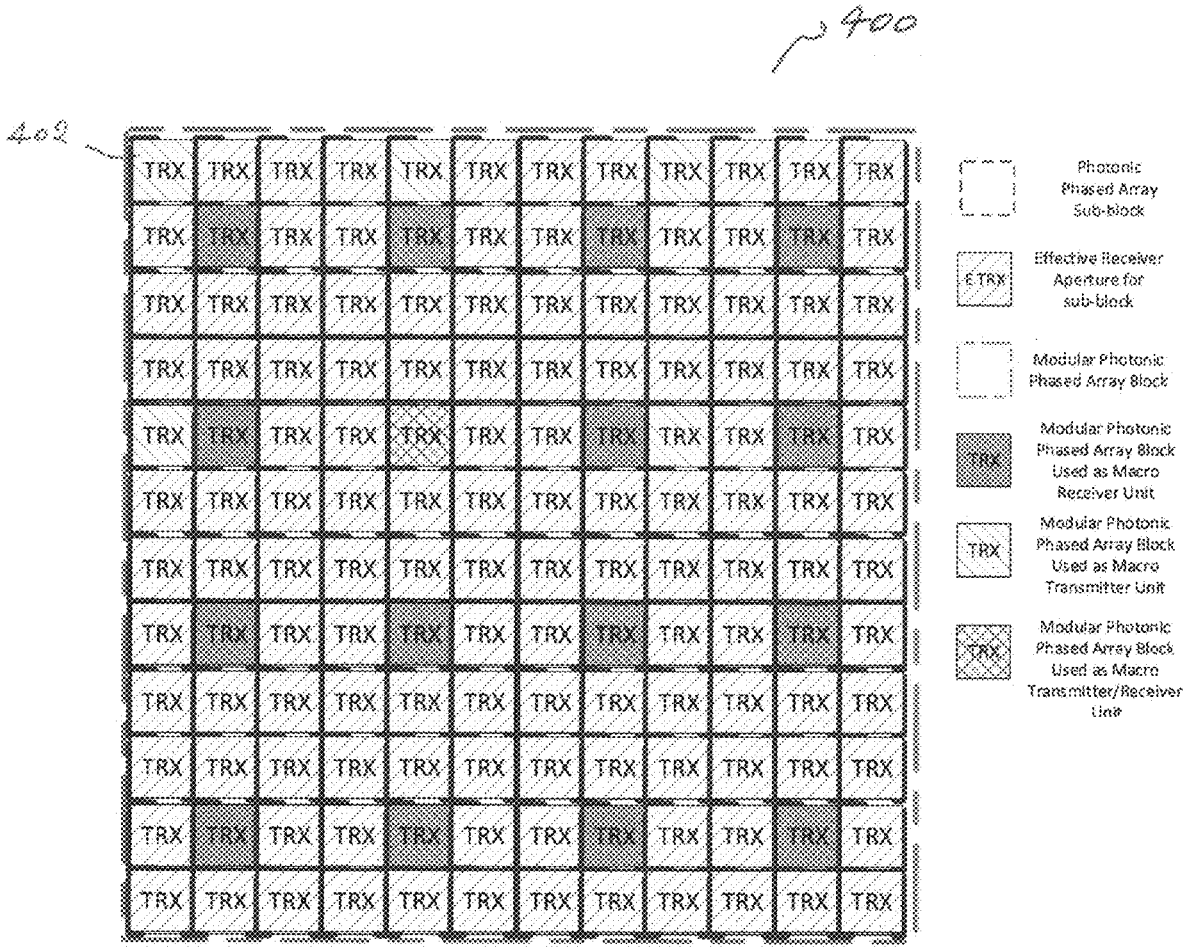
FIG. 14 shows a 12×12 phased array, in accordance with one exemplary embodiment of the present invention.

In accordance with another embodiment of the present invention, a phased array is formed by tiling together a multitude of sub-block phased arrays such that the transmitters and receivers of different sub-blocks are chosen in a co-prime fashion, thereby to suppress of the side-lobes. FIG. 14 shows an exemplary photonic phased array 400 that includes a 12×12 array of sub-blocks 402 each of which corresponds to the phased array 150 shown in FIG. 2. Sub-blocks shown in blue color in a downward diagonal pattern, namely sub-blocks disposed in array positons (1,1), (1,5), (1,7), (5,1), (5,9), (9,1), (9,5), (9,9), have their transmitters active (their receivers are not turned on) and are referred to herein alternatively as active transmitter sub-blocks. Sub-blocks shown in solid, green color, namely sub-blocks disposed in array positons (2,2), (2,5), (2,8), (2,11), (5,2), (5,9), (5,11), (9,2), (9,5), (9,9), (9,11), (11,2), (11,(, (11,9), (11,11) have the receivers active (their transmitters are not turned on), and are referred to herein alternatively as active receiver sub-blocks. It is understood that the first and second numbers in each array position define the row and column number of the array in which the sub-block is disposed. Sub-block 402 disposed in array position (5,5) is used as both a transmitter array and a receiver array.

Figure 15:
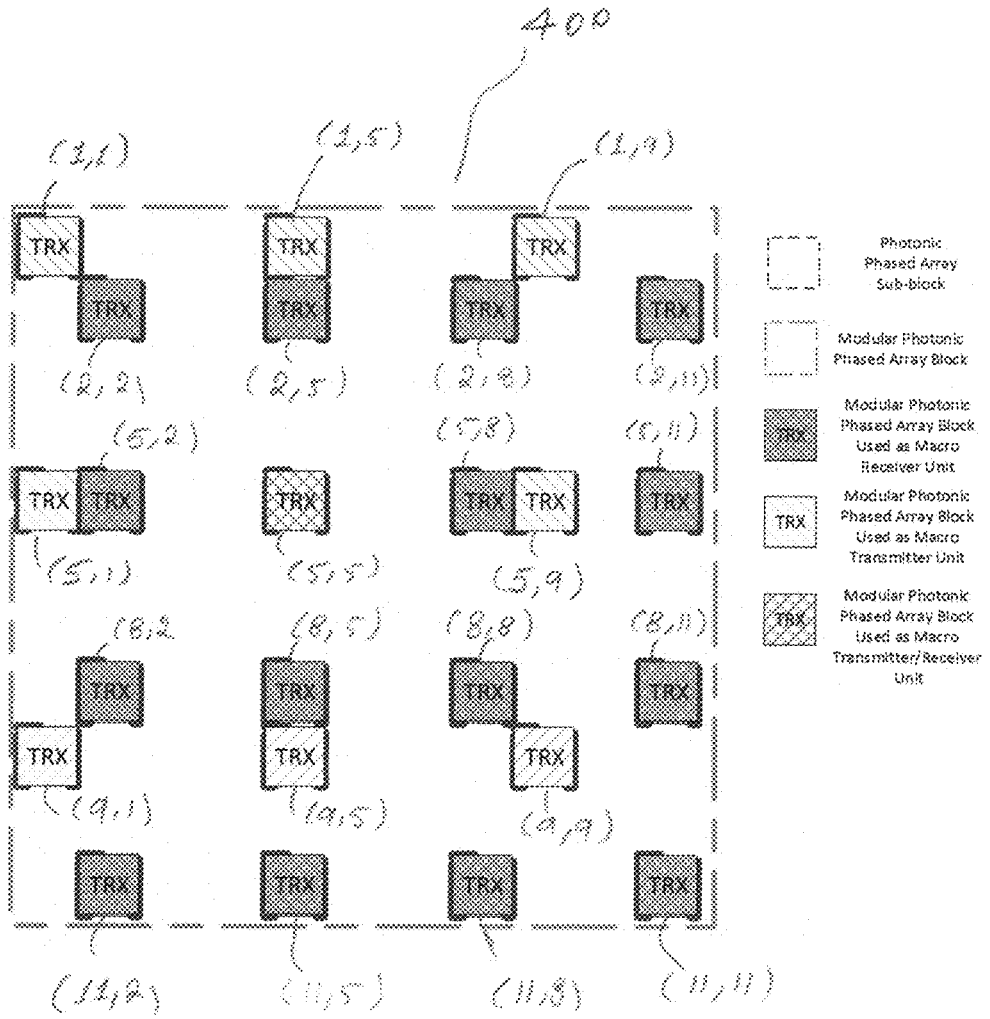
FIG. 15 shows active transmitter array, active receiver array, as well as a transmitter/receiver common to the active transmitter and active receiver arrays forming a phased array, in accordance with one exemplary embodiment of the present invention.
Figure 16:
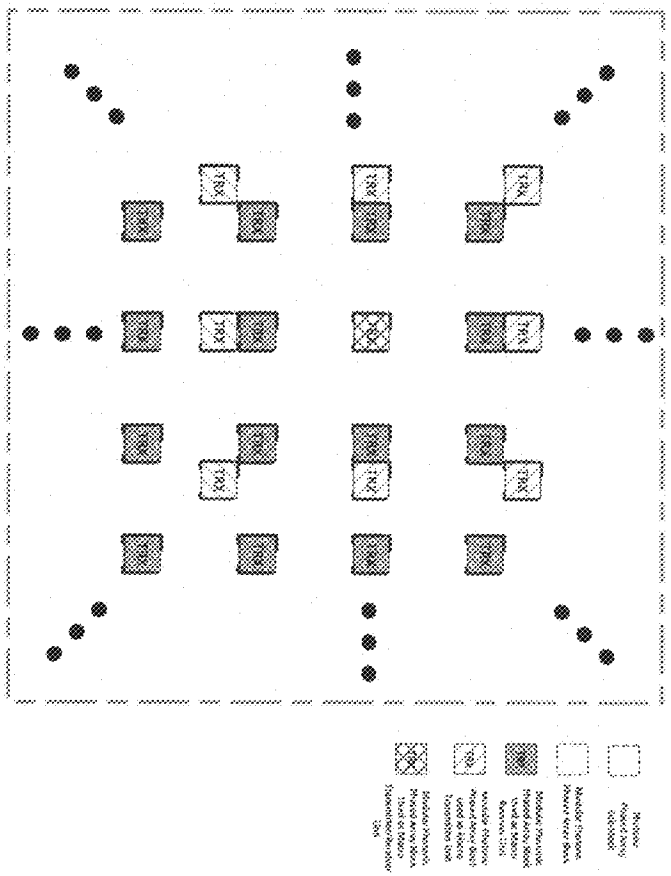
FIG. 16 shows the manner in which the phased array of FIG. 15 may be expanded to achieve a phased array of any desired size, in accordance with one exemplary embodiment of the present invention.

As is seen from FIG. 14, the spacing between each pair of nearest neighbor active transmitter sub-blocks, such as those disposed in array positions (1,1), (1,4), is 4 time the dimension of each sub-block 402. Similarly, the spacing between each pair of nearest neighbor active receiver sub-blocks, such as those disposed in array positions (2, 2), (2,5), is 3 time the dimension of each sub-block. Therefore, the active transmitter and receiver sub-blocks form a co-prime aperture size equivalent to the size of the entire aperture of array 400. FIG. 15 shows the active transmitters, receivers and transmitter/receiver of the phased array 400 of Figure together with their row and column numbers within the array. FIG. 16 shows the manner in which array 400 of FIG. 15 may be expanded to achieve a phased array of any desired size. In other words, as long as the distance between any pair of active transmitters that are nearest neighbor sub-blocks is the same and is a co-prime of the distance between any pair of active nearest neighbor receiver sub-blocks, the array may be expanded, as described above, to achieve the desired size and aperture.

Figure 17:
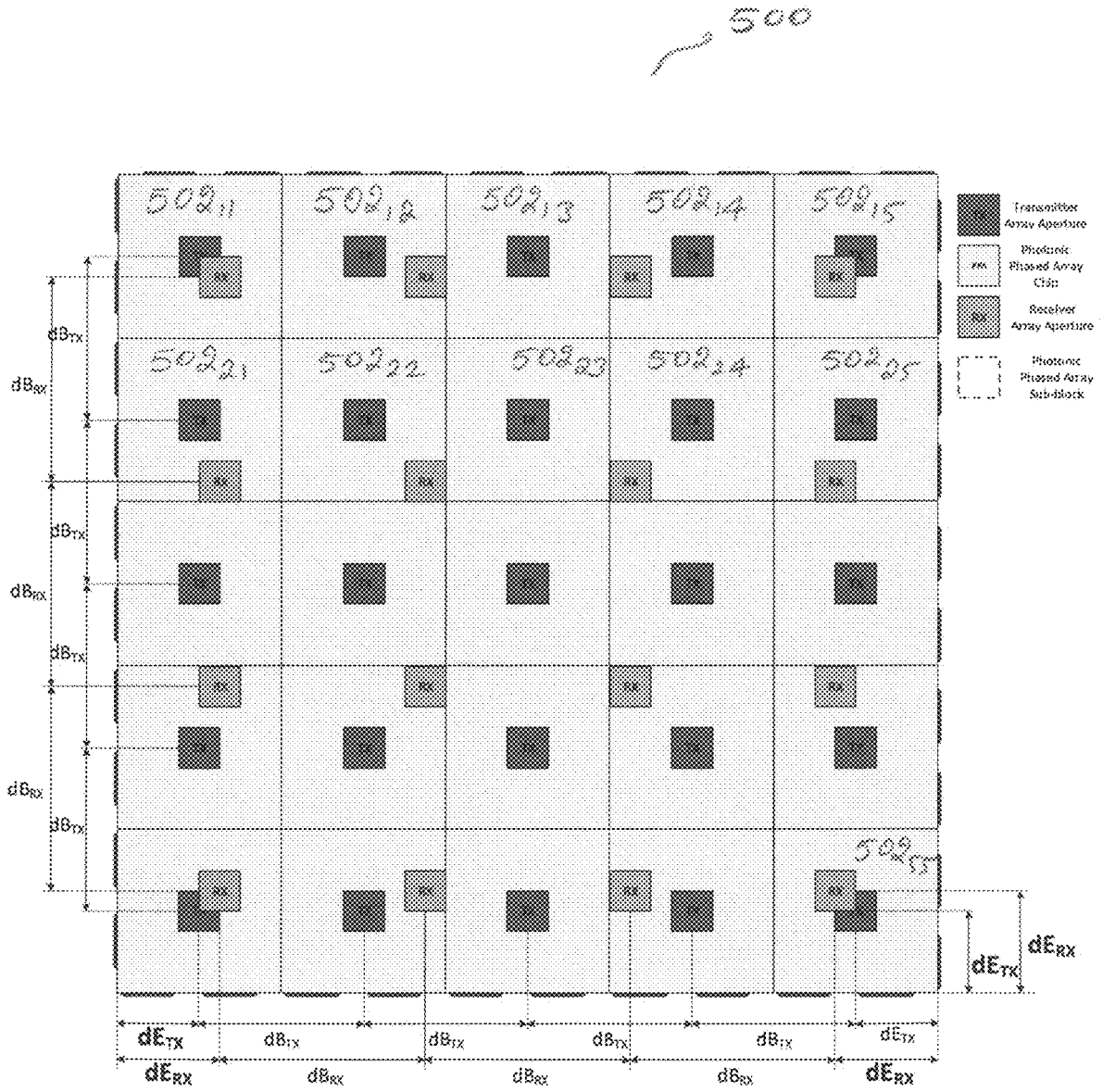
FIG. 17 shows a 5×5 phased array, in accordance with one exemplary embodiment of the present invention.

In accordance with another embodiment of the present invention, different transceiver chips are formed with different transmitter/receiver layout positions so as to enable direct tilling of the sub-blocks and without the need nested processing such as that shown in FIG. 14. FIG. 17 shows a phased array 500 that includes 25 transceiver chips $\mathbf{502}_{ij}$ arranged in a 5×5 array, where i and j respectively represent the row and column index number of the transceiver chip within the array. The transceiver chips positioned in column 3 only have a transmitter array.

As is seen from FIG. 17, the entire array 500 may be formed using only 5 distinct transceiver chips that have different spatial relationships between the their transmitter (TX) and receiver (RX) arrays. For example, the entire array 500 may be formed using transceiver chips $\mathbf{502}_{11}$, $\mathbf{502}_{12}$, $\mathbf{502}_{13}$, $\mathbf{502}_{21}$ and $\mathbf{502}_{22}$. The remaining transceiver chips can be formed by rotating the above five transceiver chips $\mathbf{502}_{11}$, $\mathbf{502}_{12}$, $\mathbf{502}_{13}$, $\mathbf{502}_{21}$, $\mathbf{502}_{22}$ by 90, 180 or 360 degrees, as was also described above. As shown in FIG. 17, the distance between transmitter and receiver aperture center to the chip edge ($dE_{TX}$, $dE_{RX}$) is half of the transmitter and receiver aperture spacing ($2dE_{TX}=dB_{TX}$, $2dE_{RX}=2\ dB_{RX}$). Array 500 is alternatively referred to herein as centro-symmetric co-prime sub-block.

Figure 18:
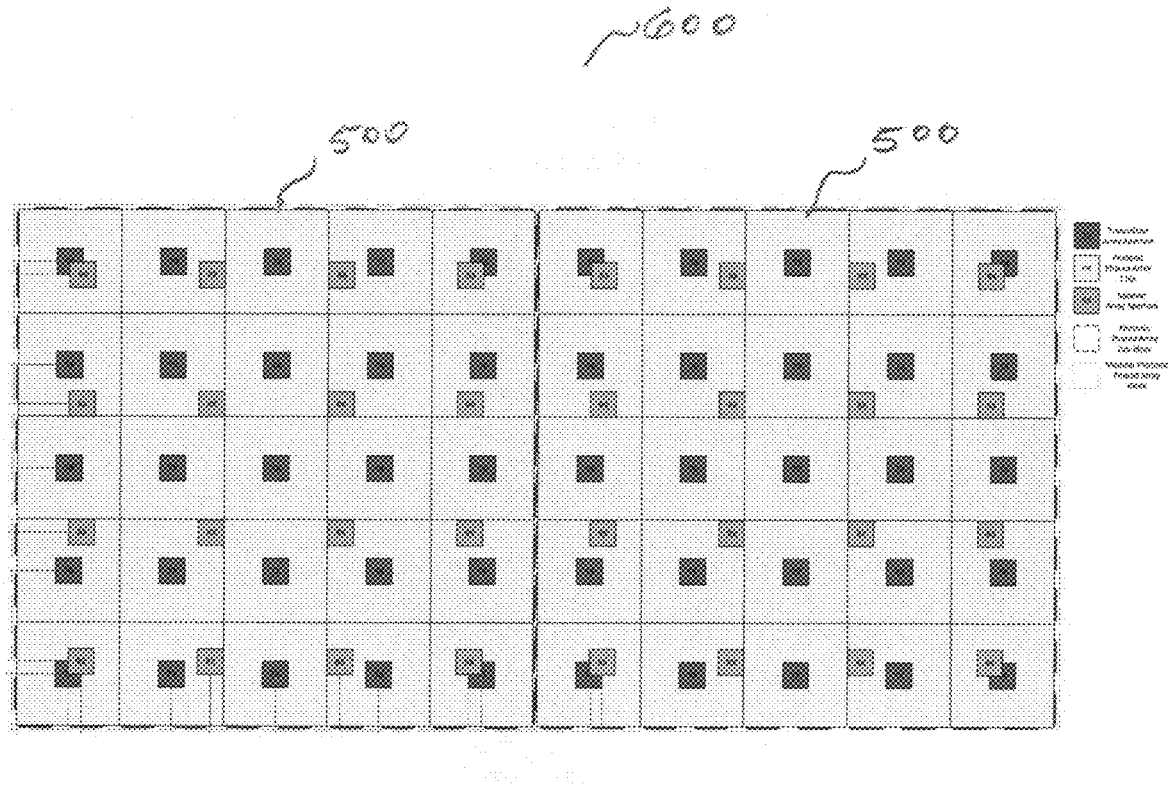
FIG. 18 shows a phased array formed by tiling together two of the phased arrays shown in FIG. 17, in accordance with one exemplary embodiment of the present invention.
Figure 19:
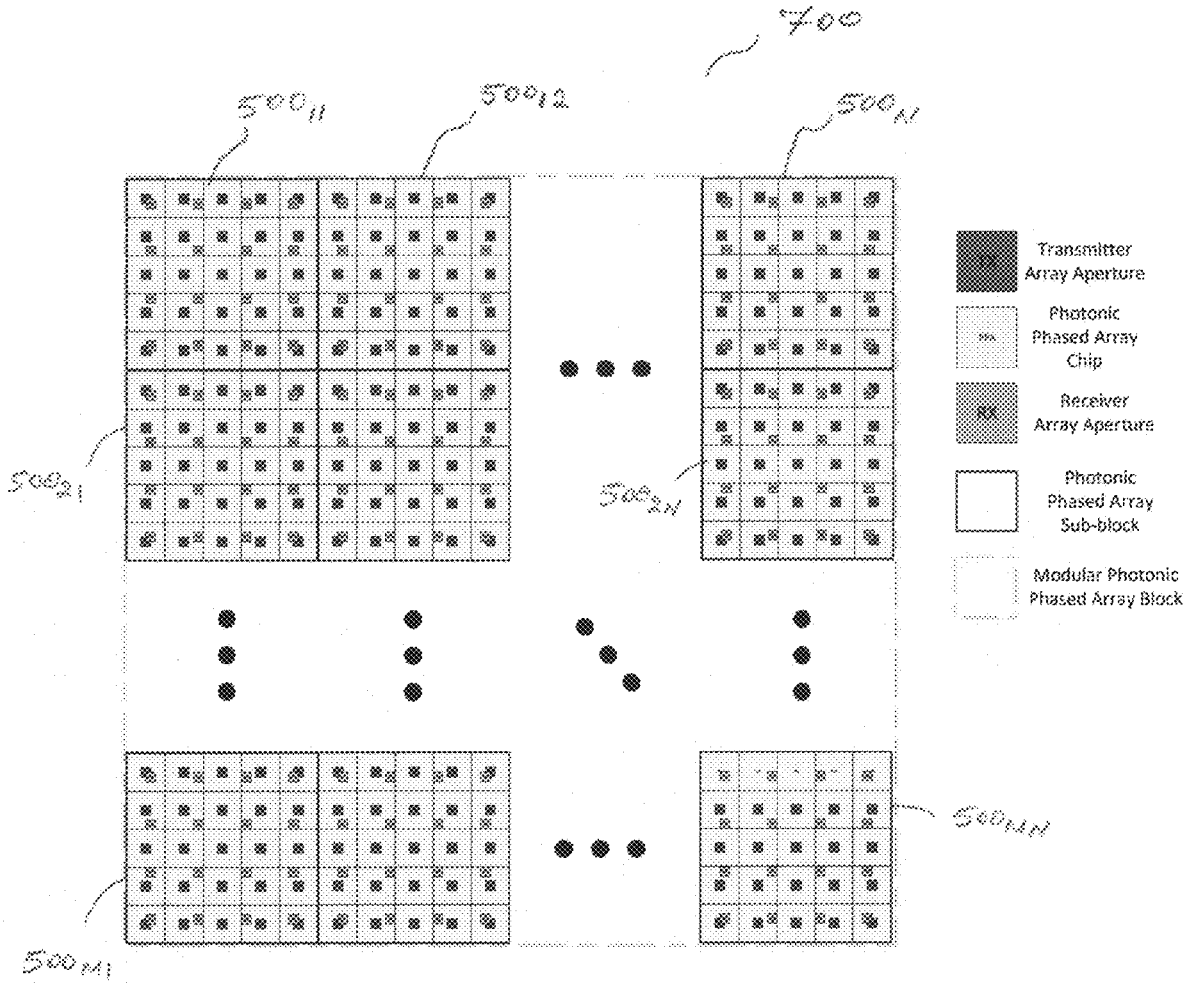
FIG. 19 shows a phased array formed by tiling together M×N of the phased arrays shown in FIG. 17, in accordance with one exemplary embodiment of the present invention.

FIG. 18 shows an array 600 formed by tiling together two centro-symmetric co-prime sub-blocks 500 of FIG. 17. Array 600 therefore is twice the size of array 500. FIG. 19 shows an array 700 formed by tiling M×N centro-symmetric co-prime sub-blocks 500 of FIG. 17 and arranging them in an array having M rows and N columns. Each centro-symmetric co-prime sub-blocks $\mathbf{500}_{ij}$ (i is an index ranging from 1 to M and j is an index ranging from 1 to N) of FIG. 19 corresponds to centro-symmetric co-prime sub-blocks 500 of FIG. 17. Array 700 therefore has a size that is M×N times greater than the size of array 500.

For the embodiments shown in FIGS. 14-18, the effective transmitter and receiver aperture of the sub-blocks will also have linear phase increments set by the phase modulators. Linear phase relationship between transmitter phase shifter given by $\phi_t$ and receiver phase shifters given by $\phi_r$ are independent of each other. Since the treatment of the transmitter and receiver elements is exactly the same, in the simplified example of the phase adjustment below, only the receiver phase values are considered. The individual radiating elements on the transceiver chips have linear phase relationship defined by $\Phi_{chip}=(0, \phi_r, 2\phi_r, 3\phi_r, \ldots, (N_r-1)\phi_r)$ for each receiving element in each direction.

It is assumed that $\phi_r$ is the relative phase between elements and $N_r$ is the number of elements within each aperture. In addition, the sub-block will have linear phase relationship defined by $\Phi_{subblock}=(0, \phi_b, 2\phi_b, \ldots, (N_{sb}-1)\phi_b)$. It is assumed that $\phi_b$ is the relative phase between apertures in different sub-blocks and $N_{sb}$ is the number of radiating apertures in the sub-blocks. Each modular block will also have linear phase increments as well. The phase relationship is defined by $\Phi_{modular\ tile}=(0, \phi_m, 2\phi_m, \ldots, (N_r-1)\phi_r)$. It is assumed that $\phi_m$ is the relative phase between apertures in different modular blocks and $N_m$ is the number of modular blocks. The effect of all the phases will be computed by the processing and control unit 802 and applied to individual modulator. For instance, the Nth radiator on the Mth sub-block, in the Pth module will have a phase setting of $(N-1)\phi_r+(M-1)\phi_b+(P-1)\phi_m$.

The difference between the tiling scheme described with reference to FIGS. 14 and 17 is in the value of the $\phi_m$. For the embodiment of FIG. 14 $\phi_m \geq N_{sb}\phi_b$ and for the embodiment of FIG. 17 $\phi_m=N_{sb}\phi_b$. In both these embodiments, all transmitter and receivers are turned-on simultaneously and signal reconstruction is done in real time.

Figure 27:
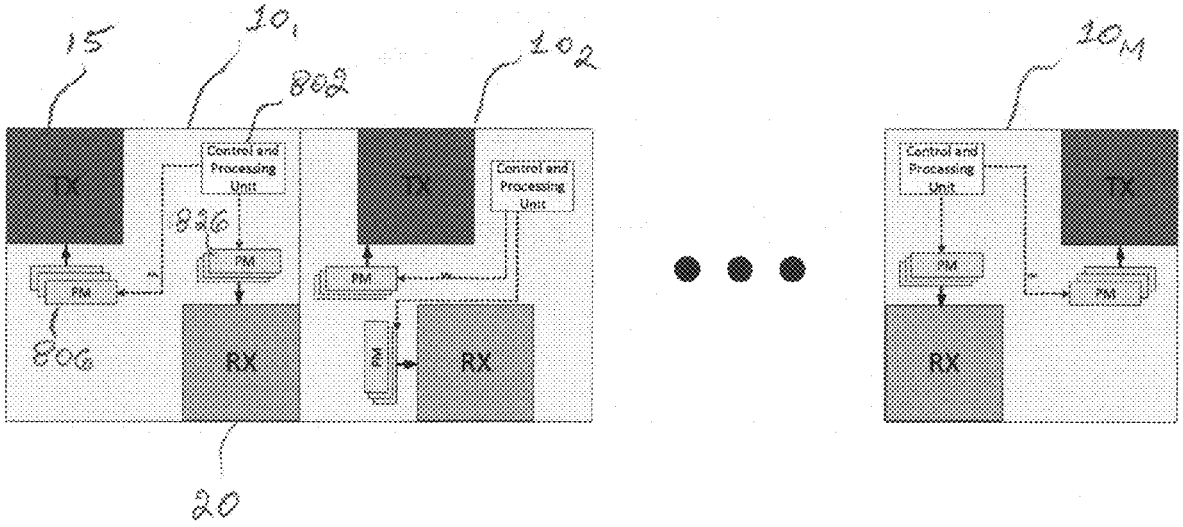
FIG. 27 is a one-dimensional phased array, in accordance with one exemplary embodiment of the present invention.

FIG. 27 shows a one-dimensional 1×M array of transceiver chips $\mathbf{10}_i$ (see FIG. 2). In addition to a transmitter 15 and a receiver 20, each transceiver chips $\mathbf{10}_i$ is also shown as including, in part, a multitude of phase modulators 826 controlling the phases of the receivers, a multitude of phase modulators 806 controlling the phases of the transmitters, and control and processing unit 802.

A co-prime sub-block operates in a similar manner to a co-prime array. The difference is that the individual radiating elements are replaced by an array of radiating elements. Since each sub-block has a single main-lobe, the co-prime array arrangement of these chips will result in a single main-lobe as well. Not only, the individual receiver and transmitter apertures have linear relative phase difference $(0, \phi_r, 2\phi_r, 3\phi_r, \ldots, (N_r-1)\phi_r)$ and $(0, \phi_t, 2\phi_t, 3\phi_t, \ldots, (N_t-1)\phi_t)$, each array with respect to the other one has also a relative linear phase difference.

For the 1×M array shown in FIG. 27, first transmitter/receiver $\mathbf{10}_1$ receives $(0, \phi_r, 2\phi_r, 3\phi_r, \ldots, (N_r-1)\phi_r)$ for their relative phases, second transmitter/receiver $\mathbf{10}_2$ receives $(0, \phi_r, 2\phi_r, 3\phi_r, \ldots, (N_r-1)\phi_r)+\phi_{rb}$, third transmitter/receiver $\mathbf{10}_3$ receives $(0, \phi_r, 2\phi_r, 3\phi_r, \ldots, (N_r-1)\phi_r)+2\phi_{rb}$, and the like. Similar linear phase difference is applied to the transmitter apertures.

The above embodiments of the present invention are illustrative and not limitative. Embodiments of the present invention are not limited by the dimension(s) of the array or the number of transmitters/receivers disposed in each array. Embodiments of the present invention are not limited by the wavelength of the electromagnetic or optical source used in the array. Embodiments of the present invention are not limited to the circuitry, such as phase modulators, splitters, detectors, control unit, mixers, and the like, used in the transmitter or receiver arrays. Other additions, subtractions or modifications are obvious in view of the present disclosure and are intended to fall within the scope of the appended claims.

What is claimed is:

1. A phased array comprising M×N photonic chips each comprising a two-dimensional array of transmitters disposed along a first plurality of rows and columns and a two-dimensional array of receivers disposed along a second plurality of rows and columns, wherein a distance between the transmitter arrays of each pair of adjacent photonics chips is defined by a first value and wherein a distance between the receiver arrays of each pair of adjacent photonics chips is defined by a second value, wherein the first and second values are co-prime numbers, and wherein at least one of M or N is an integer greater than one.

2. The phased array of claim 1 wherein a position of at least a second one of the M×N photonic chips is defined by a rotation about either an x-axis or y-axis of a first one of the M×N photonic chips.

3. The phased array of claim 1 wherein a distance between a transmitter array of a photonic chip and an edge of the photonic chip in which the transmitter array is disposed is substantially one half the first value.

4. The phased array of claim 1 wherein a distance between a receiver array of a photonic chip and an edge of the photonic chip in which the receiver array is disposed is substantially one half the second value.

5. A phased array comprising at least first and second phased array sub-blocks, each phased array sub-block comprising M×N photonic chips, each chip comprising a two-dimensional array of transmitters disposed along a first plurality of rows and columns, and a two-dimensional array of receivers disposed along a second plurality of rows and columns, wherein a distance between the transmitter arrays of each pair of adjacent photonics chips in each phased array sub-block is defined by a first value and wherein a distance between the receiver arrays of each pair of adjacent photonics chips in each phased array sub-block is defined by a second value, wherein the first and second values are co-prime numbers, and wherein at least one of M or N is an integer greater than one.

6. The phased array of claim 5 wherein a position of at least a second one of the M×N photonic chips in each phased array sub-block is defined by a rotation about either an x-axis or y-axis of a first one of the M×N photonic chips of the phased-array sub-block.

7. A phased array comprising:

a first M transceivers disposed along a first plurality of rows and columns, wherein a distance between each pair of adjacent transceivers of the first M transceivers is defined by a first value;

a second N transceiver arrays disposed along a second plurality of rows and columns, wherein a distance between each pair of adjacent transceivers of the second N transceivers is defined by a second value, wherein the first and second values are co-prime numbers, and wherein the first M transceivers and the second N transceivers include at least one common transceiver, and wherein at least one of M or N is an integer greater than one.

8. A method of forming a phased array, the method comprising:

forming a first array of photonic chips each comprising a two-dimensional array of transmitters disposed along a first plurality of rows and columns and a two-dimensional array of receivers disposed along a second plurality of rows and columns, wherein a distance between the transmitter arrays of each pair of adjacent photonics chips is defined by a first value and wherein a distance between the receiver arrays of each pair of adjacent photonics chips is defined by a second value, wherein the first and second values are co-prime numbers.

9. The method of claim 8 wherein at least a second subset of the photonic chips is formed by rotating a first subset of the photonic chips.

10. The method of claim 8 wherein a distance between a transmitter array of a photonic chip and an edge of the photonic chip in which the transmitter array is disposed is substantially one half the first value.

11. The method of claim 10 wherein a distance between a receiver array of a photonic chip and an edge of the photonic chip in which the transmitter array is disposed is substantially one half the second value.

12. A method of forming a phased array, the method comprising:

forming a first two-dimensional array of photonic chips each comprising a two-dimensional array of transmitters disposed along a first plurality of rows and columns, and a two-dimensional array of receivers disposed along a second plurality of rows and columns, wherein a distance between the transmitter arrays of each pair of adjacent photonics chips in the first array is defined by a first value and wherein a distance between the receiver arrays of each pair of adjacent photonics chips in the first array is defined by a second value, wherein the first and second values are co-prime numbers; and forming a second two-dimensional array of photonic chips each comprising a two-dimensional array of transmitters disposed along the first plurality of rows and columns, and a two-dimensional array of receivers disposed along the second plurality of rows and columns, wherein a distance between the transmitter arrays of each pair of adjacent photonics chips across the first or second array is defined by the first value and wherein a distance between the receiver arrays of each pair of adjacent photonics chips across the first and second array is defined by the second value.

13. A method of forming a phased array the method comprising:

disposing a first M transceivers along a first plurality of rows and columns, wherein a distance between each pair of adjacent transceivers of the first M transceivers is defined by a first value;

disposing a second N transceiver arrays along a second plurality of rows and columns, wherein a distance between each pair of adjacent transceivers of the second N transceivers is defined by a second value, wherein the first and second values are co-prime numbers, and wherein the first M transceivers and the second N transceivers include at least one common transceiver, and wherein at least one of M or N is an integer greater than one.

14. A method of forming a phased array, the method comprising:

disposing M transmitters along a first plurality of rows and columns to form a first two-dimensional array;

disposing N receivers along a second plurality of rows and columns to form a second two-dimensional array; and disposing a transceiver in the first and second arrays such that transceiver is common to both the first and second arrays, wherein a distance between each transmitter in the first array and an adjacent transmitter in the first array is defined by a first value, and wherein a distance between each receiver in the second array and an adjacent receiver in the second array is defined by a second value, wherein the first and second values are co-prime numbers, wherein each of the M transmitters in the first array and each of the N receivers in the second array is a transceiver photonic chip.

* * * * *